US012523020B2

(12) United States Patent
Furudate et al.

(10) Patent No.: US 12,523,020 B2
(45) Date of Patent: Jan. 13, 2026

(54) RIPPER POINT ATTACHMENT STRUCTURE AND RIPPER POINT

(71) Applicant: KOMATSU LTD., Tokyo (JP)

(72) Inventors: Yudai Furudate, Tokyo (JP); Daijirou Tanaka, Tokyo (JP); Masakuni Ueda, Tokyo (JP); Monta Kondou, Tokyo (JP); Jinnai Hatsushi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 429 days.

(21) Appl. No.: 18/044,253

(22) PCT Filed: Oct. 5, 2021

(86) PCT No.: PCT/JP2021/036727
§ 371 (c)(1),
(2) Date: Mar. 7, 2023

(87) PCT Pub. No.: WO2022/075296
PCT Pub. Date: Apr. 14, 2022

(65) Prior Publication Data

US 2023/0332381 A1 Oct. 19, 2023

(30) Foreign Application Priority Data

Oct. 7, 2020 (JP) ..... 2020-169862

(51) Int. Cl.
*E02F 9/28* (2006.01)
*E02F 5/32* (2006.01)

(52) U.S. Cl.
CPC ..... *E02F 9/2875* (2013.01); *E02F 5/32* (2013.01)

(58) Field of Classification Search
CPC ..... E02F 9/2875; E02F 5/32
See application file for complete search history.

(56) References Cited

U.S. PATENT DOCUMENTS 4,932,478 A * 6/1990 Jones ..... E02F 9/2875 37/456
5,704,100 A * 1/1998 Swan ..... F16B 21/186 24/546
6,574,892 B2 * 6/2003 Creighton ..... E02F 9/2833 37/456
8,495,826 B2 * 7/2013 Itou ..... E02F 9/2875 37/456

(Continued)

FOREIGN PATENT DOCUMENTS

CN 2122174 U 11/1992
CN 101951842 A 1/2011

(Continued)

OTHER PUBLICATIONS

The International Search Report for the corresponding international application No. PCT/JP2021/036727, issued on Dec. 14, 2021.

(Continued)

*Primary Examiner* — Matthew R Buck
(74) *Attorney, Agent, or Firm* — GLOBAL IP COUNSELORS, LLP

(57) ABSTRACT

With a ripper point attachment structure, a pin member is inserted into a first pin hole formed in a ripper shank and a second pin hole formed in a ripper point. A locking member is engaged with the pin member to prevent the pin member from coming loose. The ripper point includes an opening, an internal space and a guide groove. The opening is formed at a rear end. The internal space is formed from the opening toward a distal end surface. The guide groove is formed in a predetermined range from the rear end toward the distal end surface in a portion of an inner surface forming the internal space. A second pin hole of the ripper point is disposed on a bottom surface of the guide groove. The locking member is disposed in a space forming the guide groove.

9 Claims, 21 Drawing Sheets

(56) References Cited

U.S. PATENT DOCUMENTS

| | | | | |
|---|---|---|---|---|
| 2004/0060207 | A1* | 4/2004 | Livesay | E02F 9/2825 37/451 |
| 2004/0237354 | A1* | 12/2004 | Emrich | E02F 9/2841 37/450 |
| 2013/0081833 | A1* | 4/2013 | Rivera | E02F 9/2875 172/713 |
| 2017/0014901 | A1 | 1/2017 | Powell | |
| 2017/0051476 | A1 | 2/2017 | Rol Corredor et al. | |
| 2017/0226718 | A1* | 8/2017 | Snyder | E02F 9/2833 |
| 2019/0024349 | A1* | 1/2019 | Ortiz Garcia | E02F 9/2858 |
| 2022/0275608 | A1 | 9/2022 | Nagata et al. | |
| 2022/0298758 | A1 | 9/2022 | Nagata et al. | |

FOREIGN PATENT DOCUMENTS

| | | | |
|---|---|---|---|
| CN | 102510923 | A | 6/2012 |
| JP | 2003-176814 | A | 6/2003 |
| JP | 2006-514178 | A | 4/2006 |
| JP | 2016-75070 | A | 5/2016 |
| JP | 2019-510145 | A | 4/2019 |
| JP | 2019-148113 | A | 9/2019 |
| WO | 2017/137619 | A1 | 8/2017 |
| WO | 2021/049543 | A1 | 3/2021 |
| WO | 2021/049544 | A1 | 3/2021 |

OTHER PUBLICATIONS

First Chinese Office Action received for Chinese Application Serial No. 202180050267.X, mailed on Mar. 20, 2025, 16 pages. (Including English Translation).

The Office Action for the corresponding Japanese application No. 2020-169862 issued on Jul. 9, 2024.

The examination report No. 2 for the corresponding Australian application No. 2021358204 issued on Jun. 25, 2024.

* cited by examiner

RIPPER POINT ATTACHMENT STRUCTURE AND RIPPER POINT

CROSS-REFERENCE TO RELATED APPLICATIONS

This application is a U.S. National stage application of International Application No. PCT/JP2021/036727, filed on Oct. 5, 2021. This U.S. National stage application claims priority under 35 U.S.C. § 119(a) to Japanese Patent Application No. 2020-169862, filed in Japan on Oct. 7, 2020, the entire contents of which are hereby incorporated herein by reference.

BACKGROUND

Field of the Invention

The present disclosure relates to a ripper point attachment structure and a ripper point.

Description of the Related Art

As prior art, International Laid-Open Publication No. 2019-148113 discloses a ripper point attachment structure used in a ripper device. With a conventional ripper point attachment structure for a ripper device, the ripper point is attached to the ripper shank via a pin member. In this case, for example, the pin member is prevented from coming loose by forming a groove in the center of the pin member and engaging a C-shaped retainer in the groove.

SUMMARY

In a conventional ripper point attachment structure, it is difficult to attach the pin member to the ripper point and the ripper shank due to the large frictional resistance when the pin member passes through the retainer. Also, when replacing the ripper point, it is difficult to remove the pin member from the ripper point and the ripper shank.

It is an object of the present disclosure to provide a ripper point attachment structure that allow easy attachment and detachment of the ripper point. It is another object of the present disclosure to provide a ripper point that can be easily attached to and detached from an attachment target.

A ripper point attachment structure according to a first aspect is a ripper point attachment structure in a ripper device. The ripper point comprises a ripper point, a ripper shank, a pin member, and a locking member. The ripper point includes a wedge shape extending from a distal end to a rear end. The ripper point is attached to the ripper shank. The pin member is inserted into a first through hole formed in the ripper shank and a second through hole formed in the ripper point. The locking member is engaged with the pin member to prevent the pin member from coming loose. The ripper point includes an opening, an internal space and a concave portion. The opening is formed at a rear end. The internal space is formed from the opening toward the distal end. The concave portion is formed in a predetermined range from the rear end to the distal end in a portion of an inner surface forming the internal space. The second through hole of the ripper point is disposed on a bottom surface of the concave portion. The locking member is disposed in a space forming the concave portion.

A ripper point according to a second aspect is configured to be attached to a ripper shank. The ripper point includes a ripper point main body, a concave portion, and a pin hole.

The ripper point body includes an opening formed at a rear end and an internal space formed from the opening toward a distal end. The concave portion is formed in a predetermined range from the rear end to the distal end in a portion of the inner surface forming the internal space. A through hole is provided on a bottom surface of the concave portion.

The ripper point attachment structure of the present disclosure allows easy attachment and detachment of the ripper point. The ripper point of the present disclosure can be easily attached to and detached from an attachment target.

BRIEF DESCRIPTION OF DRAWINGS

FIGS. 4A and 4A1 are oblique views of a ripper shank in Embodiment 1 of the present disclosure;

FIGS. 4B and 4B1 are oblique views of the ripper shank in Embodiment 1 of the present disclosure;

DETAILED DESCRIPTION

A ripper point attachment structure according to an embodiment will now be described with reference to the drawings.

Embodiment 1

The configuration of the ripper point attachment structure in a ripper device 1 according to Embodiment 1 will be described with reference to the drawings.

Overview of Ripper Device 1

Figure 1:
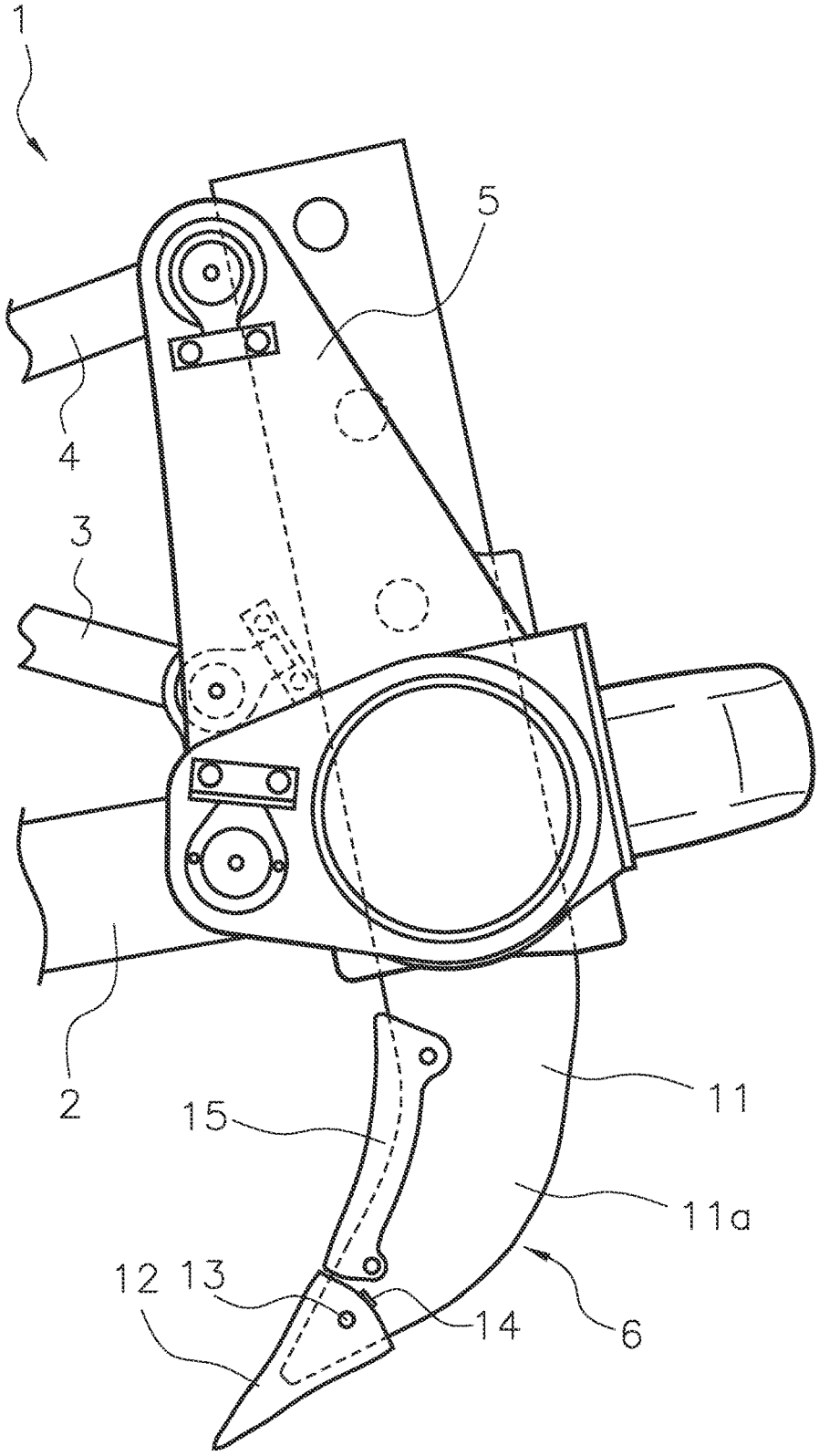
FIG. 1 is a side view of a ripper device in Embodiment 1 of the present disclosure.

FIG. 1 is a side view of the ripper device 1.

The ripper device 1 is attached to a bulldozer, for example. The ripper device 1 is attached to the rear of the vehicle body of the bulldozer. The ripper device 1 includes an arm 2, a lift cylinder 3, a tilt cylinder 4, a ripper support member 5, and a ripper point attachment structure 6.

One end of the arm 2 is connected to the body of the bulldozer, and the other end of the arm 2 is connected to the ripper support member 5. The ripper support member 5 is rotatably attached to the arm 2.

One end of the lift cylinder 3 and one end of the tilt cylinder 4 are connected to the body of the bulldozer. The other ends of lift cylinder 3 and tilt cylinder 4 are connected to the ripper support member 5. The ripper support member 5 is rotatably attached to the lift cylinder 3 and the tilt cylinder 4. The lift cylinder 3 and tilt cylinder 4 are hydraulic cylinders.

In the ripper point attachment structure 6, the ripper point 12 is detachably attached to the ripper device 1.

Ripper Point Attachment Structure 6

Figure 2A:
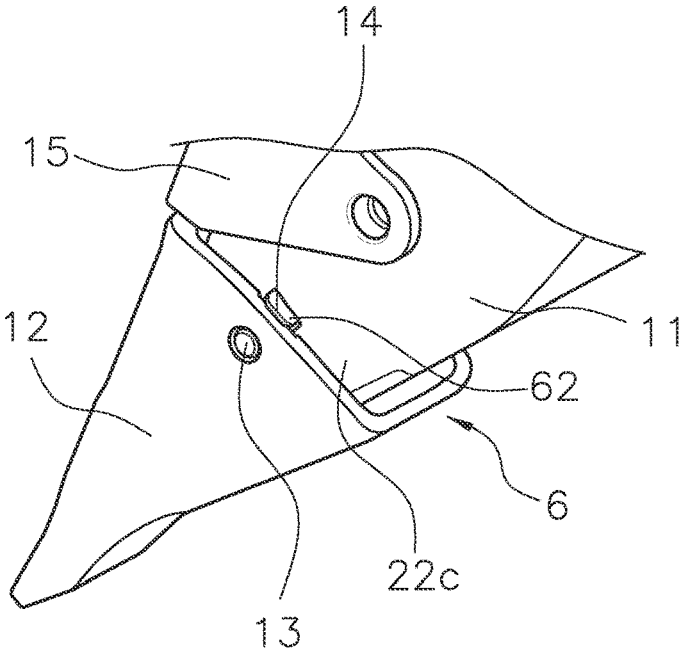
FIG. 2A is an oblique view of a ripper point attachment structure in Embodiment 1 of the present disclosure.
Figure 2B:
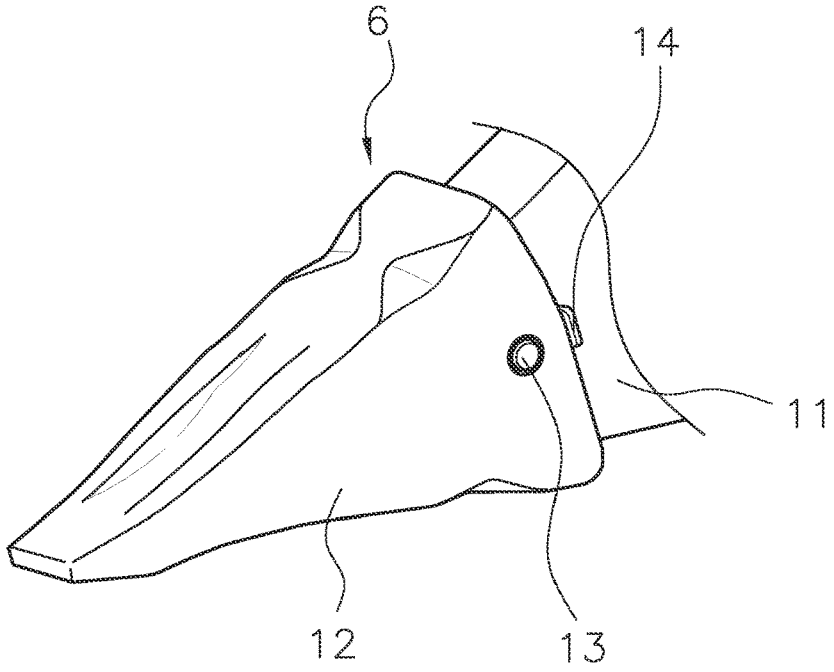
FIG. 2B is an oblique view of the ripper point attachment structure in Embodiment 1 of the present disclosure.
Figure 2C:
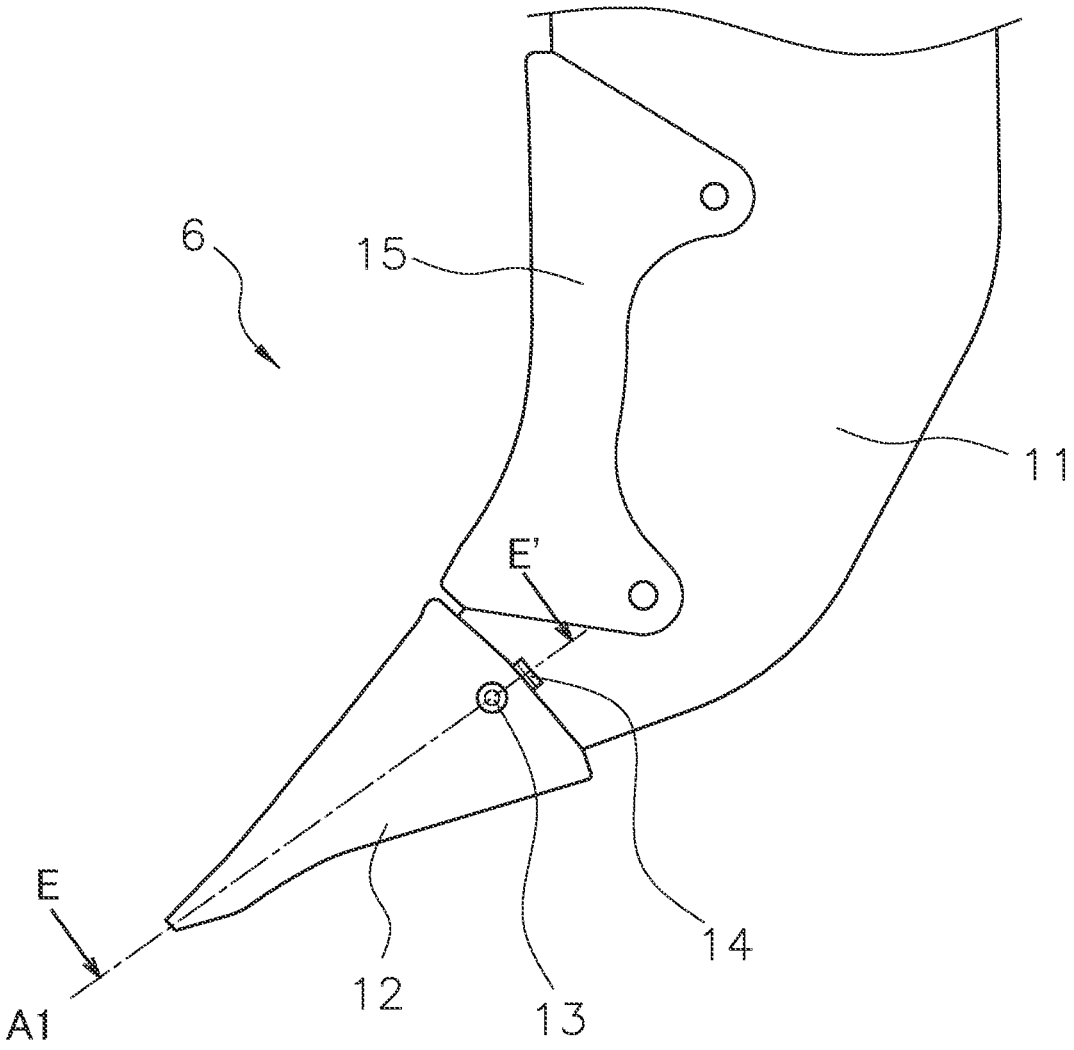
FIG. 2C is a side view of the ripper point attachment structure in Embodiment 1 of the present disclosure.
Figure 3:
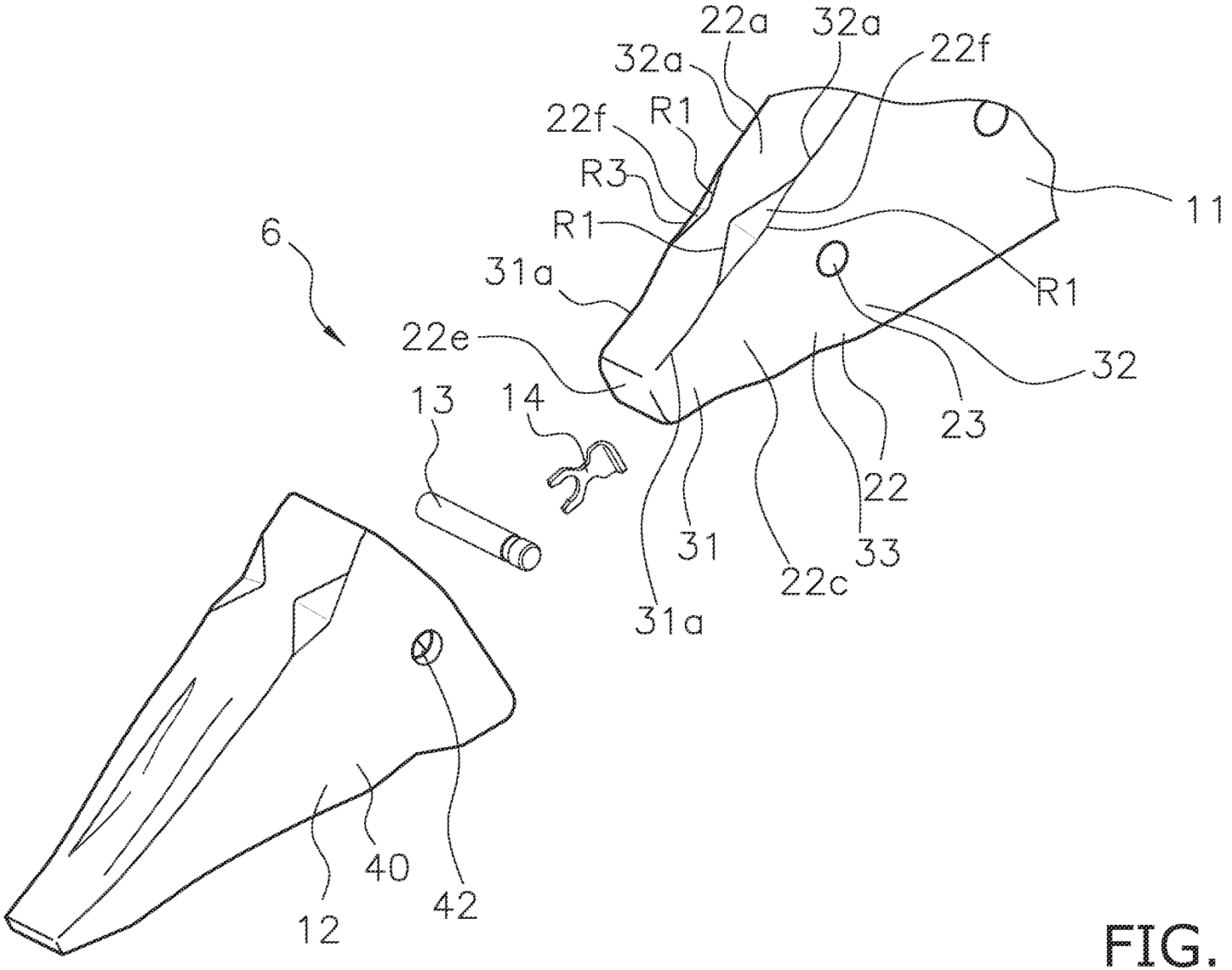
FIG. 3 is an exploded oblique view showing the ripper point attachment structure in Embodiment 1 of the present disclosure.

FIG. 2A is a detail oblique view of the ripper point attachment structure 6 as viewed from the rear. FIG. 2B is a detail oblique view of the ripper point attachment structure 6 as viewed from the front (as opposed to FIG. 2A). FIG. 2C is a side view of the ripper point attachment structure 6. FIG. 3 is an exploded view of the ripper point attachment structure 6.

The ripper point attachment structure 6 includes a ripper shank 11, a ripper point 12, a pin member 13, and a locking member 14, as shown in FIG. 1.

The ripper shank 11 is attached to the ripper support member 5. The ripper point 12 is attached to the distal end of the ripper shank 11. The pin member 13 is inserted into a through-hole formed in each of the ripper point 12 and the ripper shank 11 to prevent the ripper point 12 from coming off the ripper shank 11. The locking member 14 locks the pin member 13 inserted into the through-hole.

The ripper point attachment structure 6 of this embodiment is further provided with a protector 15 that protects the ripper shank 11 from earth and sand. The protector 15 is provided on the body-side edge of the ripper shank 11. The protector 15 is not shown in FIG. 2B.

Ripper Shank 11

Figure 4A:
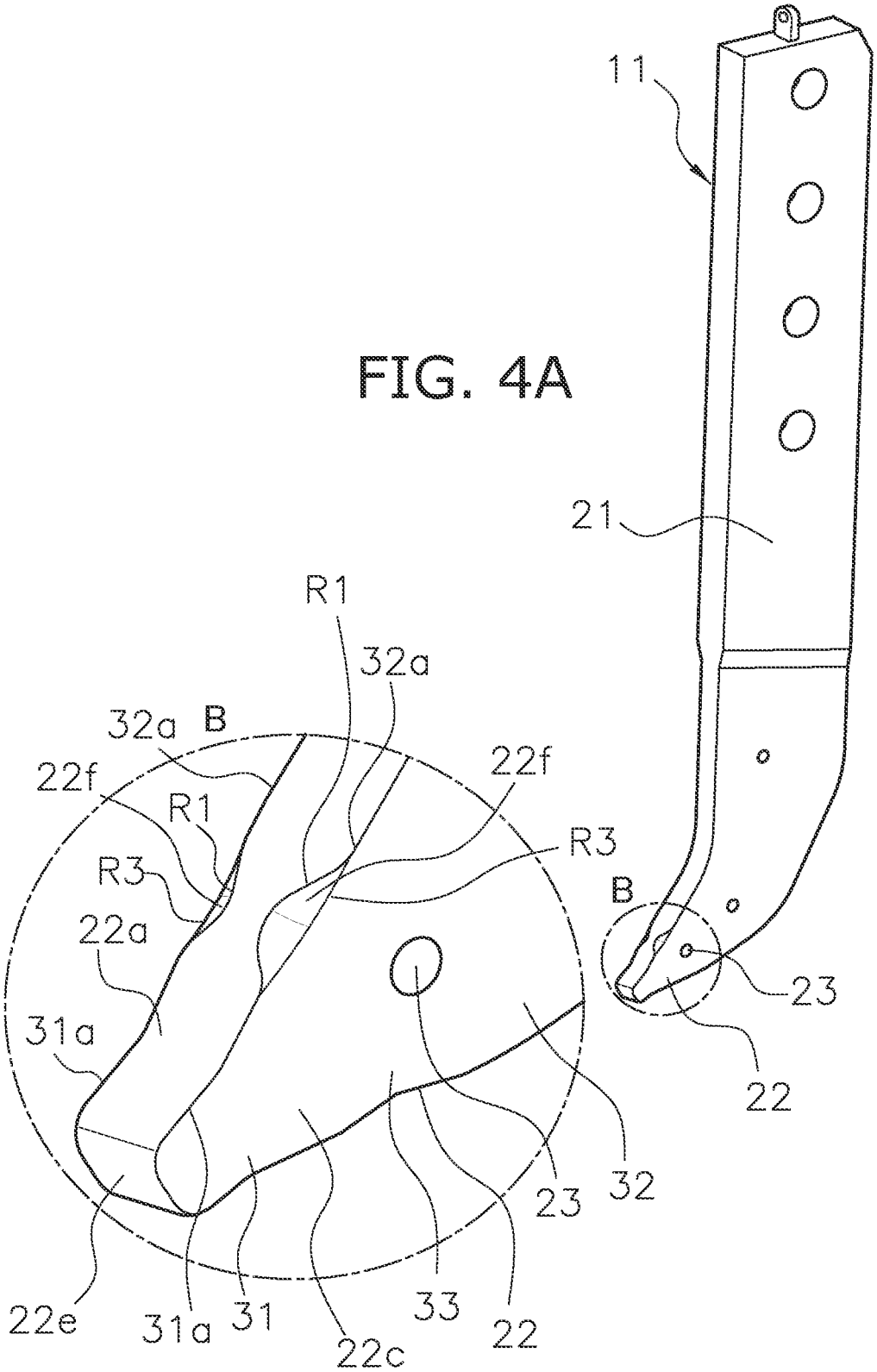
Figure 4B:
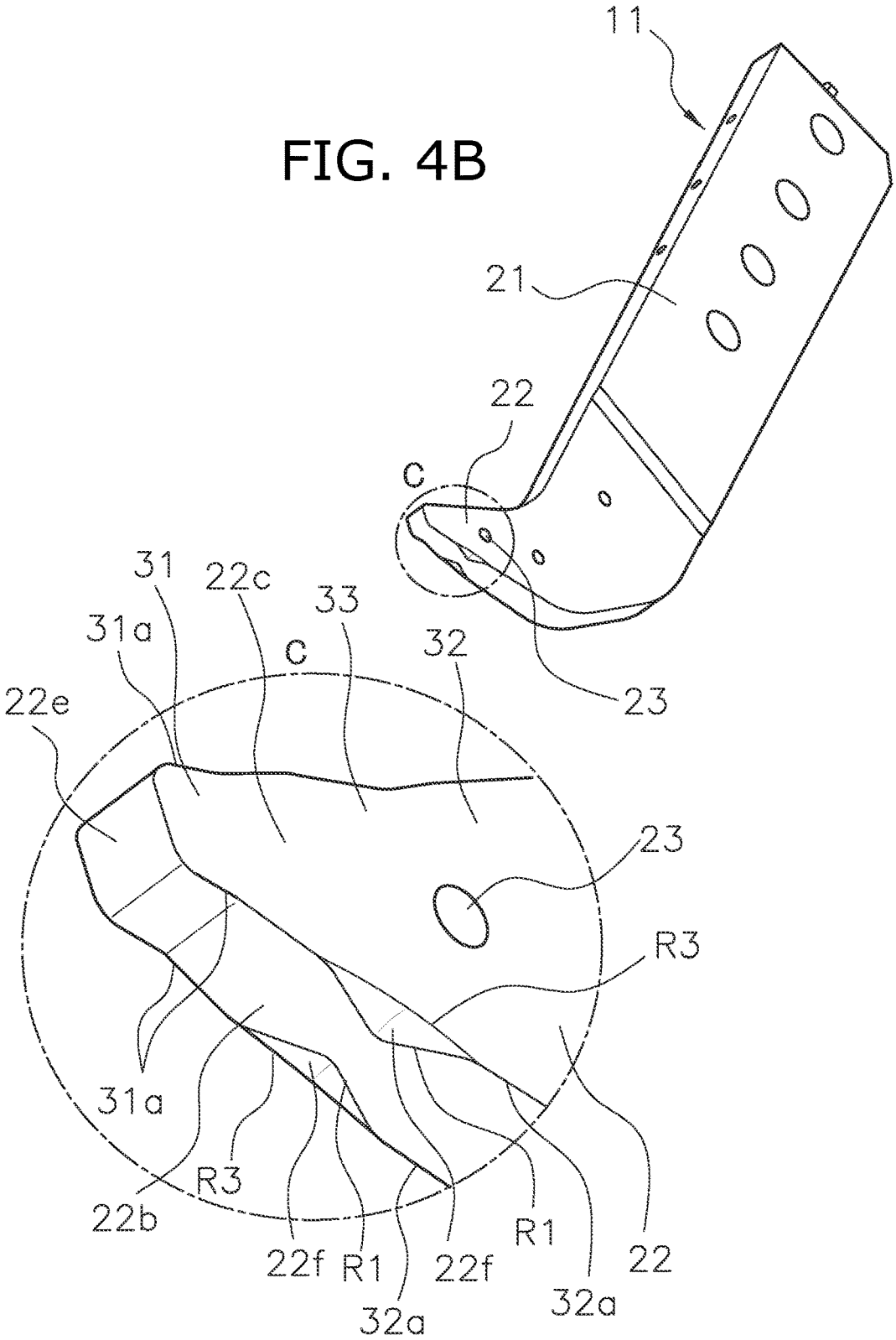

FIGS. 4A and 4A1 are oblique views of the ripper shank 11 as viewed from the front. FIGS. 4B and 4B1 are oblique views of the ripper shank 11 as viewed from below.

The ripper shank 11 is a substantially flat member that is attached to the ripper support member 5, and the distal end portion on the excavation side includes a pointed, curved shape. The ripper shank 11 is made of steel, for example. The ripper shank 11 is preferably made by forging, but is not limited to this, and may instead be made by casting.

As shown in FIGS. 4A and 4A1 and 4B and 4B1, the ripper shank 11 includes a main body portion 21, a nose portion 22, and a first pin hole 23 (an example of a through-hole).

Main Body Portion 21

The main body portion 21 is disposed substantially along the vertical direction, and is attached to the ripper support member 5. The end (lower end portion) of the main body portion 21 on the excavation side curves toward the front side of the vehicle body.

Nose Portion 22

The nose portion 22 is disposed at the excavation-side end (lower end) of the main body portion 21. The nose portion 22 is formed integrally with the main body portion 21. The nose portion 22 is formed so as to extend forward and downward from the main body portion 21.

Figure 5A:
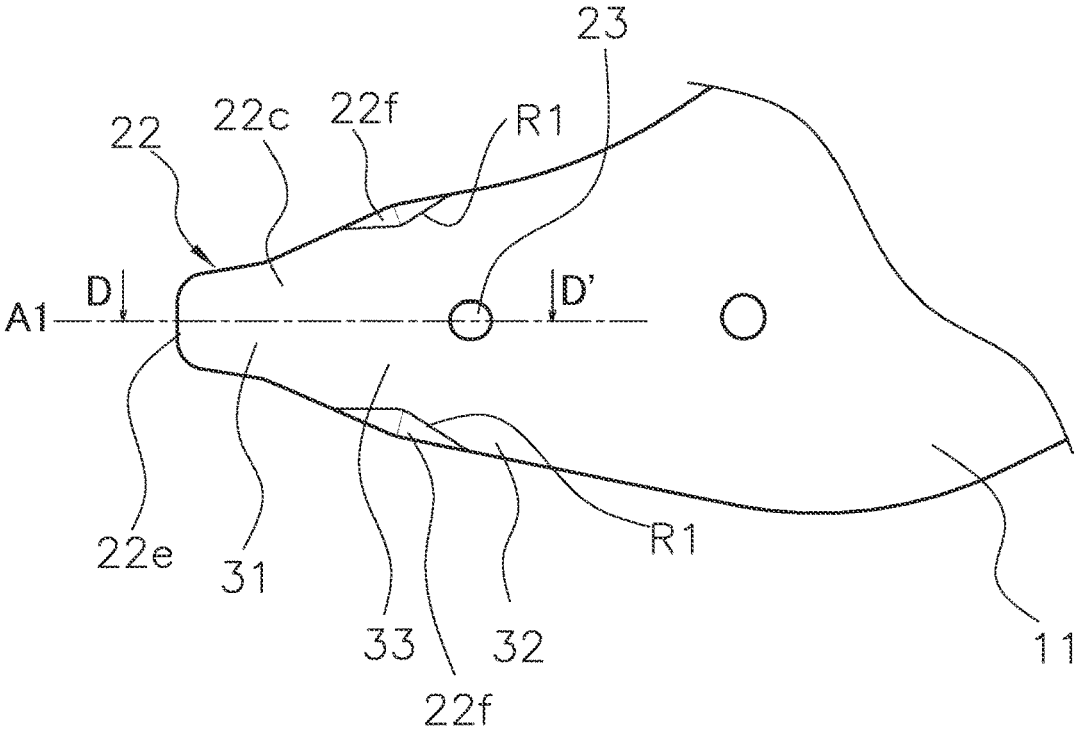
FIG. 5A is a side view of a nose portion of the ripper shank in Embodiment 1 of the present disclosure.
Figure 5B:
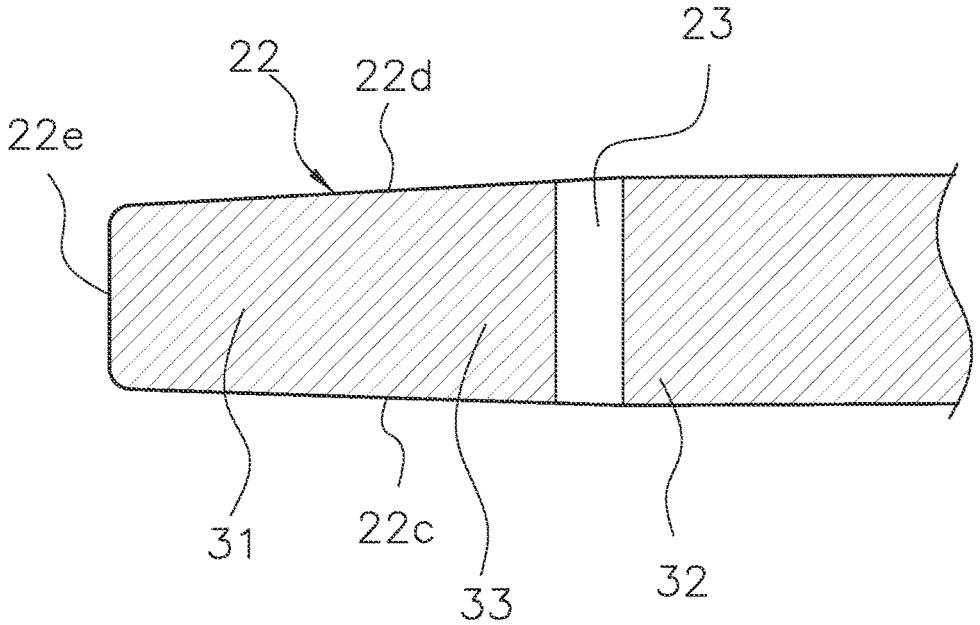
FIG. 5B is a cross-sectional view of along the D-D' line in FIG. 5A.

FIG. 4A1 also shows a detail view of the vicinity of the nose portion 22 (see B surrounded by a one-dot chain line). FIG. 4B1 also shows a detail view of the vicinity of the nose portion 22 (see C surrounded by a one-dot chain line). FIG. 5A is a side view showing the vicinity of the nose portion 22. FIG. 5B is a cross-sectional view along the D-D' line in FIG. 5A.

The nose portion 22 is formed in a tapered shape, as shown in FIGS. 4A and 4A1 and 4B and 4B1. The nose portion 22 is formed longer in one direction. The direction in which the nose portion 22 extends (also referred to as the lengthwise direction) is referred to as the axis A1 (see FIG. 5A).

The nose portion 22 includes a first surface 22*a* on the inner side of the curve, a second surface 22*b* on the outer side of the curve, a third surface 22*c* and a fourth surface 22*d* that are side surfaces provided opposite each other so as to connect the two ends of the first surface 22*a* and the second surface 22*b* in the width direction (a direction perpendicular to the axis A1), and a distal end surface 22*e* that is provided so as to connect the distal ends of the first surface 22*a*, the second surface 22*b*, the third surface 22*c*, and the fourth surface 22*d*. The first surface 22*a* and the second surface 22*b* are approximately rectangular in plan view. The third surface 22*c* and the fourth surface 22*d* are approximately triangular in side view. The distal end surface 22*e* is approximately rectangular when viewed from the front. A concave portion 22*f* is formed between the first surface 22*a* and the third surface 22*c*, between the first surface 22*a* and the fourth surface 22*d*, between the second surface 22*b* and the third surface 22*c*, and between the second surface 22*b* and the fourth surface 22*d*.

The axis A1 in FIG. 2C passes through the center of the distal end surface 22*e* of the nose portion 22, and the center of gravity of the nose portion 22 in a front view of the distal end surface 22*e* of the nose portion 22 as viewed from the outside, for example.

The nose portion 22 includes a distal end portion 31, a proximal end portion 32, and a linking portion 33, as shown in FIG. 5A.

The distal end portion 31 is provided at the distal end of the nose portion 22. The proximal end portion 32 is provided to the main body-side portion of the nose portion 22, and is contiguous with the main body portion 21. The linking portion 33 is provided between the distal end portion 31 and the proximal end portion 32 of the nose portion 22.

Figure 6:
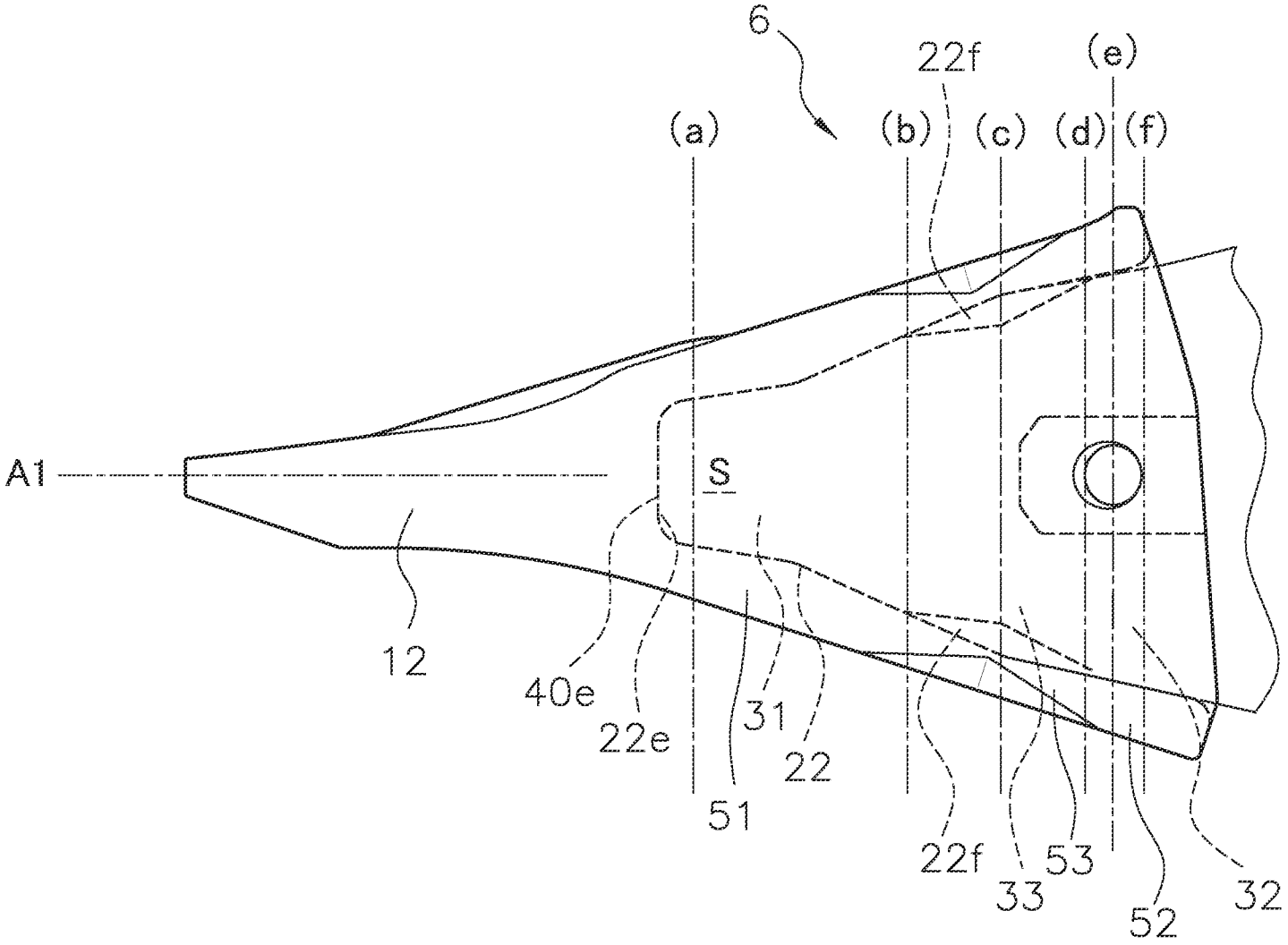
FIG. 6 is a side view of the ripper point attachment structure in Embodiment 1 of the present disclosure.
Figures 7A, 7B, 7C, 7D, 7E, 7F:
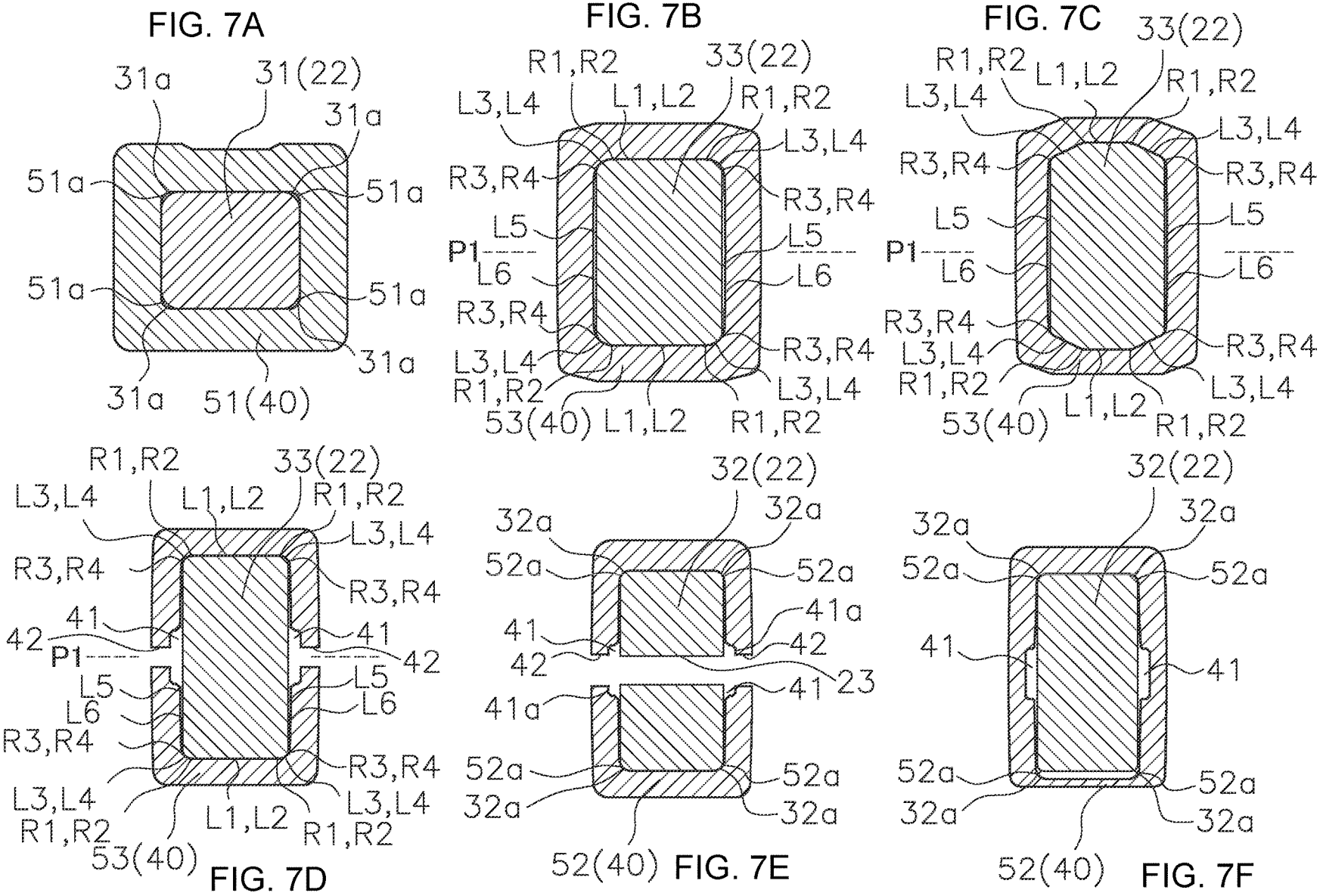
FIG. 7A is a cross-sectional view of the plane (a) in FIG. 6.
FIG. 7B is a cross-sectional view of the plane (b) in FIG. 6.
FIG. 7C is a cross-sectional view of the plane (c) in FIG. 6.
FIG. 7D is a cross-sectional view of the plane (d) in FIG. 6.
FIG. 7E is a cross-sectional view of the plane (e) in FIG. 6.
FIG. 7F is a cross-sectional view of the plane (f) in FIG. 6.

FIG. 6 is a side view of the ripper point attachment structure 6. FIGS. 7A to 7F are cross-sectional views of the ripper point attachment structure taken along the cutting lines (a) to (f) shown in FIG. 6. FIG. 7A is a cross-sectional view of the ripper point attachment structure 6 at the distal end portion 31. FIG. 7B is a cross-sectional view of the ripper point attachment structure 6 at the starting end of the concave portion 22*f* along the axis A1 (the starting end when viewed from the distal end portion 31 side). FIG. 7C is a cross-sectional view of the ripper point attachment structure 6 at the center of the concave portion 22*f* along the axis A1. FIG. 7D is a cross-sectional view of the ripper point attachment structure 6 at the terminal end of the concave portion 22*f* along the axis A1 (the terminal end when viewed from the distal end portion 31 side). FIG. 7E is a cross-sectional view of the ripper point attachment structure 6 at the center of the first pin hole 23 along the axis A1. FIG. 7F is a cross-sectional view of the ripper point attachment structure 6 at the rear end of the first pin hole 23 along the axis A1 (the end when viewed from the distal end portion 31 side).

As shown in FIGS. 6 and 7A, the outer periphery of the cross section obtained by cutting the distal end portion 31 along a cutting plane (a) perpendicular to the axis A1 of the nose portion 22 is formed in a rectangular shape. The term "periphery" here may be interpreted as the "outer shape." The "plane" perpendicular to the axis A1 of the nose portion 22 shall hereinafter be referred to as the "cutting plane."

As shown in FIG. 6, the distal end portion 31 is disposed in an internal space S of the ripper point 12 so as to be able to come into contact with the inner surface of the ripper point 12 in the axial direction in which the axis A1 of the nose portion 22 extends. Here, the distal end portion 31 is defined as the portion of the outer shape in the cutting plane that is rectangular.

As shown in FIG. 5A, the proximal end portion 32 is provided contiguously with the main body portion 21. For example, the proximal end portion 32 is formed integrally with the main body portion 21. As shown in FIGS. 6, 7E, and 7F, the outer periphery of a cross section obtained by cutting the proximal end portion 32 along the planes (e) and (f) is formed in a rectangular shape. Here, the proximal end portion 32 is defined as the portion of the outer shape in the cutting plane that has a rectangular shape. The nose portion 22 is defined as the part from the distal end portion 31 to the proximal end portion 32. Also, as shown in FIG. 7E, the first pin hole 23 is formed in the proximal end portion 32.

There are no particular restrictions on the range of the main body portion 21 and the nose portion 22 of the ripper shank 11, and the distal end side of the ripper shank 11 beyond the lower end of the protector 15 may serve as the nose portion 22, and the portion above the lower end of the protector 15 may serve as the main body portion 21. Also, for example, the linear portion of the ripper shank 11 may serve as the main body portion 21, and the curved portion may serve as the nose portion 22.

As shown in FIG. 6, the linking portion 33 is provided between the distal end portion 31 and the proximal end portion 32. The linking portion 33 is formed integrally with the distal end portion 31 and the proximal end portion 32, for example.

The outer periphery of the linking portion 33 is formed in an octagonal shape. For example, the outer periphery of a cross section obtained by cutting the linking portion 33 along the cutting plane (b), the cutting plane (c), and the cutting plane (d) is formed in an octagonal shape. The concave portions 22*f* mentioned above are formed in the linking portion 33. That is, since the concave portions 22*f* are formed in the linking portion 33 at each of the four corners formed by the four surfaces 22*a*, 22*b*, 22*c*, and 22*d* of the nose portion 22, the linking portion 33 is octagonal in cross section, and a cross section at the distal end portion 31 and the proximal end portion 32 is rectangular. Thus, the linking portion 33 is defined as the portion where the outer periphery of the cross section is formed into an octagon.

The cutting plane (b) and the cutting plane (d) correspond to the end of a concave portion 22*f*, and thus have a shape that is approximately rectangular.

Of the eight sides of the octagon, the sides L1 that are opposite each other are provided parallel to a plane P1 including the axis A1 of the nose portion 22 and the axis A2 of the pin member 13. The two ends of each side L1 form a first ridgeline portion R1 that links the corner portion 32*a* of the proximal end portion 32 and the corner portion 31*a* of the distal end portion 31, as shown in FIGS. 4A, 4A1 and 7C. The opposing sides L1 correspond to the widths of the first surface 22*a* and the second surface 22*b* perpendicular to the axis A1.

Of the eight sides of the octagon, the sides L5 that are opposite each other are provided perpendicular to the plane P1. As shown in FIGS. 4A, 4A1 and 7C, the two ends of the sides L5 form a third ridgeline portion R3 that links the corner portion 32*a* of the proximal end portion 32 and the corner portion 31*a* of the distal end portion. The opposing sides L5 correspond to the widths of the third surface 22*c* and the fourth surface 22*d* perpendicular to the axis A1.

As shown in FIGS. 7B and 7C, sides L3 that are between the sides L1 and L5 of the linking portion 33 and are adjacent to the sides L1 and L5 each form one side of the outer periphery of the octagonal shape of the linking portion 33. The sides L3 form surfaces between the first ridgeline portion R1 and the third ridgeline portion R3. The sides L3 are provided as four of the eight sides of the octagon. The four sides L3 each correspond to the width of a concave portion 22*f* perpendicular to the axis A1.

Here, as shown in FIGS. 7D and 7C, the length of the side L1 of the central portion of the linking portion 33 in the lengthwise direction (the length of the side L1 in FIG. 7C) is shorter than the length of the side L1 of the linking portion 33 on the proximal end portion 32 side (the length of the side L1 in FIG. 7D). Also, the length of the side L1 of the central portion of the linking portion 33 in the lengthwise direction (the length of the side L1 in FIG. 7C) is the shorter than length of the side L1 of the linking portion 33 on the distal end portion 31 side (the length of the side L1 in FIG. 7B).

The sides L1 gradually become shorter from the proximal end portion 32 toward the central portion of the linking portion 33 (see FIGS. 7D and 7C). Also, the sides L1 gradually become longer from the central portion of the linking portion 33 toward the distal end portion 31 (see FIGS. 7C, 7B, 4A, 4A1, 4B and 4B1).

As shown in FIGS. 7B, 7C, and 7D, the length of the sides L3 of the central portion of the linking portion 33 in the lengthwise direction (the length of the sides L3 in FIG. 7C) is longer than the length of the sides L3 of the linking portion 33 on the proximal end portion 32 side (the length of the sides L3 in FIG. 7D). Also, the length of the sides L3 of the central portion of the linking portion 33 in the lengthwise direction (the length of the sides L3 in FIG. 7C) is longer than the length of the sides L3 of the linking portion 33 on the distal end portion 31 side (the length of the sides L3 in FIG. 7B).

As shown in FIG. 3, the sides L3 gradually become longer from the proximal end portion 32 toward the central portion of the linking portion 33 (see FIGS. 7D and 7C). Also, the sides L3 gradually become shorter from the central portion of the linking portion 33 toward the distal end portion 31 (see FIGS. 7C and 7B).

The sides L5 gradually become shorter from the proximal end portion 32 toward the central portion of the linking portion 33 (see FIGS. 7D, 7C, 4A, 4A1, 4B and 4B1). Also, the sides L5 gradually become shorter from the central portion of the linking portion 33 toward the distal end portion 31 (see FIGS. 7C and 7B).

Also, the above-mentioned concave portions 22*f* correspond to the portions of the linking portion 33 sandwiched between the first ridgeline portion R1 and the third ridgeline portion R3.

Also, the rectangular vertexes of the distal end portion 31 (corner portions 31*a*), the octagonal vertexes of the linking portion 33, and the rectangular vertexes of the proximal end portion 32 (corner portions 32*a*) are connected in that order from the distal end portion 31 toward the proximal end portion 32.

First Pin Hole 23

The first pin hole 23 is provided to the nose portion 22. The first pin hole 23 extends in a direction perpendicular to the axis A1 of the nose portion 22. More precisely, the first pin hole 23 is provided to the proximal end portion 32 as mentioned above.

Figure 5C:
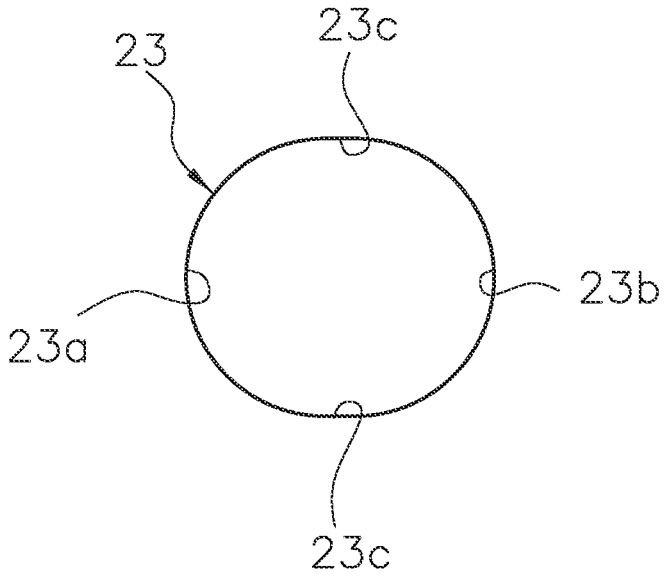
FIG. 5C is a detail view of a first pin hole in Embodiment 1 according to the present disclosure.

FIG. 5C is a detail side view of the first pin hole 23 shown in FIG. 5A. The pin member 13 is inserted into the first pin hole 23 of the nose portion 22. As shown in FIG. 5C, the inner peripheral surface of the first pin hole 23 is formed in an elongated shape. As shown in FIG. 5C, the first inner peripheral surface 23*a* of the first pin hole 23 formed on the distal end surface 22*e* side of the nose portion 22 is formed in an arc shape. The radius at which the first inner peripheral surface 23*a* is formed is larger than the radius of the pin member 13.

A second inner peripheral surface 23*b* of the first pin hole 23 formed on the opposite side from the distal end surface 22*e* of the nose portion 22 (which could also be called the main body portion 21 side) is formed in an arc shape. The radius at which the second inner peripheral surface 23*b* is formed is larger than the radius of the pin member 13. The spacing (major axis) between the first inner peripheral surface 23*a* and the second inner peripheral surface 23*b* is larger than the diameter of the pin member 13. The major axis is disposed along the axis A1, for example.

A pair of third inner peripheral surfaces 23*c* formed between the first inner peripheral surface 23*a* and the second inner peripheral surface 23*b* are formed in a planar shape. The spacing (minor axis) between the pair of third inner peripheral surfaces 23*c* is larger than the diameter of the pin member 13.

This will be discussed below in greater detail with reference to FIG. 10A, but in a state in which the ripper point 12 is attached to the ripper shank 11, the pin member 13 linking the ripper point 12 and the ripper shank 11 comes into contact with the first inner peripheral surface 23*a*. Since the cross-sectional shape of the pin member 13 is circular, a gap T is formed between the pin member 13 and the second inner peripheral surface 23*b* on the proximal end portion 32 side (main body portion 21 side), as will be discussed below.

Ripper Point 12

As shown in FIGS. 2A to 2C and FIG. 3, the ripper point 12 is attached to ripper shank 11. The ripper point 12 has a wedge shape extending from a distal end surface 40*g* (an example of the distal end) to a rear end 40*i*.

Figure 8A:
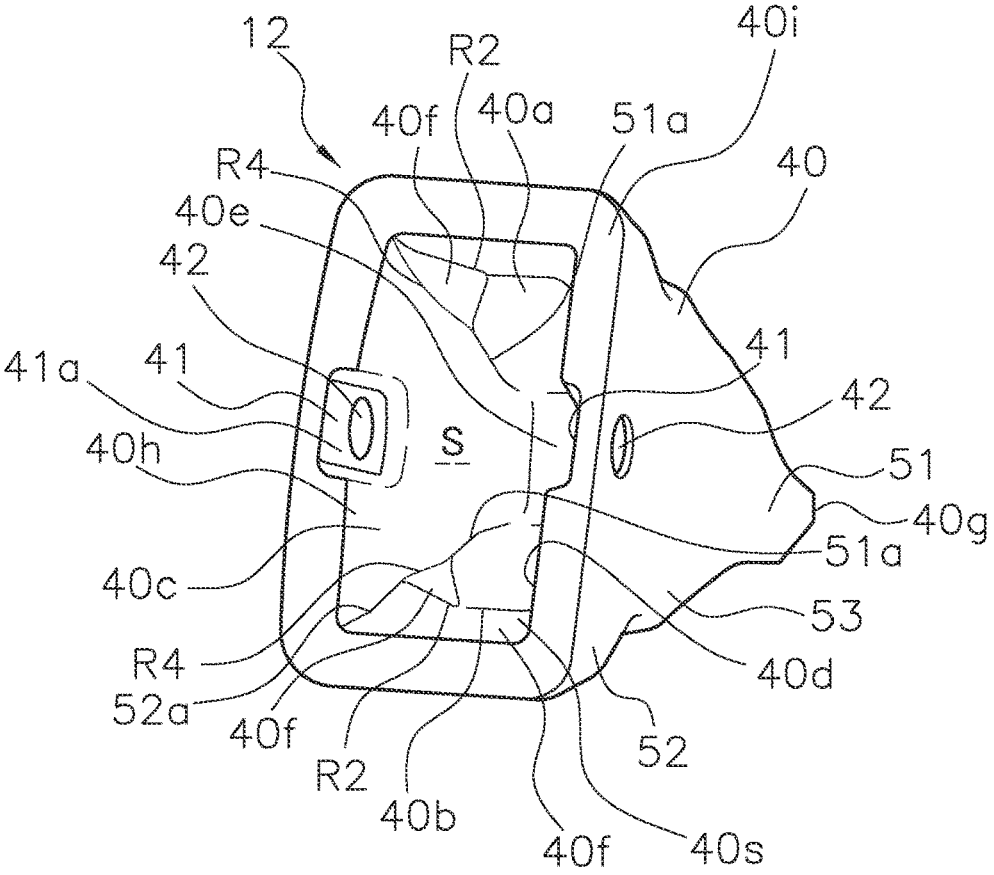
FIG. 8A is an oblique view of the ripper point in Embodiment 1 of the present disclosure.

FIG. 8A is an oblique view of the ripper point 12 as viewed from the opposite side from the distal end. As shown in FIG. 8A, the ripper point 12 includes an internal space S (see FIG. 6) for inserting the nose portion 22 of the ripper shank 11. The inner surface of ripper point 12 is formed along the outer surface of ripper shank 11. The ripper point 12 is made of steel, for example. The ripper point 12 is preferably made by forging, but this is not the only option, and may be made by casting instead.

The ripper point 12, when attached to the ripper shank 11, extends along the axis A1, as shown in FIG. 2C.

The ripper point 12 includes a ripper point main body 40, a guide groove 41 (an example of a concave portion), and a second pin hole 42, as shown in FIG. 8A.

The ripper point main body 40 is formed in a bottomed cylindrical shape. The inner surface of the ripper point main body 40 is formed along the outer surface of the nose portion 22. The inner surface of the ripper point main body 40 is formed in a tapered shape. Forming the ripper point main body 40 in this way forms the above-mentioned internal space S. The nose portion 22 of the ripper shank 11 is disposed in the internal space S (see FIG. 6).

As shown in FIG. 8A, the ripper point main body 40 includes, as an inner surface 40*s* forming the internal space S, a first surface 40*a*, a second surface 40*b*, a third surface 40*c* and a fourth surface 40*d* that are side surfaces opposite each other, and a distal end surface 40*e*.

The first surface 40*a* is a surface located on the inside of the bend when the ripper point 12 is attached to the ripper shank 11. The second surface 40*b* is a surface located on the outside of the bend in a state in which the ripper point 12 is attached to the ripper shank 11. The first surface 40*a* and the second surface 40*b* are approximately rectangular in plan view. The third surface 40*c* is formed so as to link the first surface 40*a* and the second surface 40*b*. The fourth surface 40*d* is formed so as to link the first surface 40*a* and the second surface 40*b*. The third surface 40*c* and the fourth surface 40*d* are approximately triangular in side view. The distal end surface 40*e* is formed so as to link the end of the first surface 40*a* on the distal end side, the end of the second surface 40*b* on the distal end side, the end of the third surface 40*c* on the distal end side, and the end of the fourth surface 40*d* on the distal end side.

Figure 9:
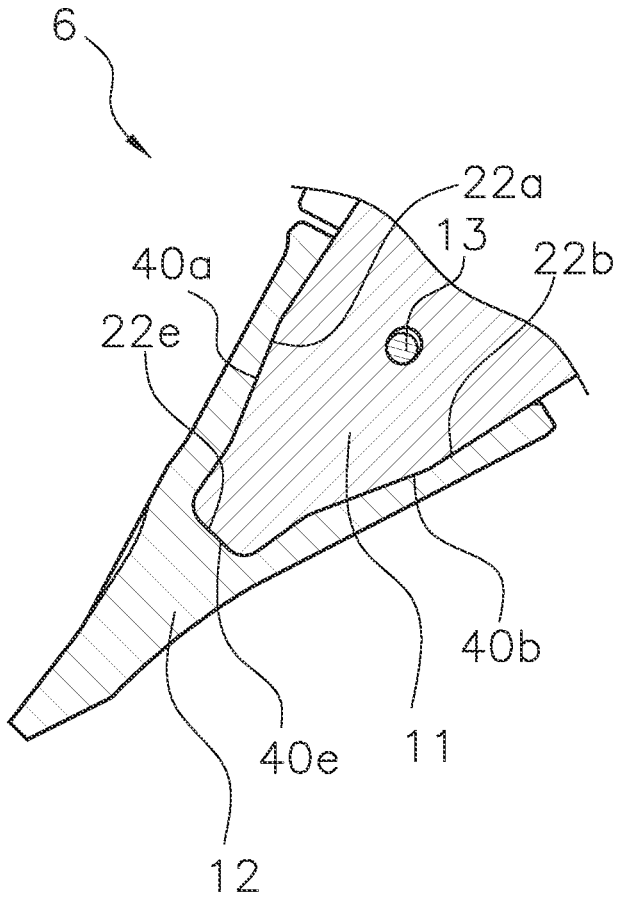
FIG. 9 is a side cross-sectional view of the ripper point attachment structure in Embodiment 1 of the present disclosure.

In a state in which the ripper point 12 is attached to the ripper shank 11, the first surface 40*a* is opposite the first surface 22*a*, the second surface 40*b* is opposite the second surface 22*b*, the third surface 40*c* is opposite the third surface 22*c*, and the fourth surface 40*d* is opposite the fourth surface 22*d*. FIG. 9 is a side cross-sectional view of a state in which the ripper point 12 is attached to the ripper shank 11. As shown in FIG. 9, in a state in which the ripper point 12 is attached to the ripper shank 11, the distal end surface 40*e* is opposite the distal end surface 22*e* of the nose portion 22 and comes into contact with the distal end surface 22*e*.

The first surface 40*a* and the first surface 22*a*, the second surface 40*b* and the second surface 22*b*, the third surface 40*c* and the third surface 22*c*, the fourth surface 40*d* and the fourth surface 22*d*, and the distal end surface 40*e* and the distal end surface 22*e* are formed to be approximately the same size as one another.

As shown in FIG. 8A, a convex portion 40*f* is formed between the first surface 40*a* and the third surface 40*c*, between the first surface 40*a* and the fourth surface 40*d*, between the second surface 40*b* and the third surface 40*c*, and between the second surface 40*b* and the fourth surface 40*d*. In a state in which the ripper point 12 is attached to the ripper shank 11, the various convex portions 40*f* are opposite and come into contact with the four concave portions 22*f*. The convex portions 40*f* are formed in a shape corresponding to the opposing concave portions 22*f*.

Figure 8B:
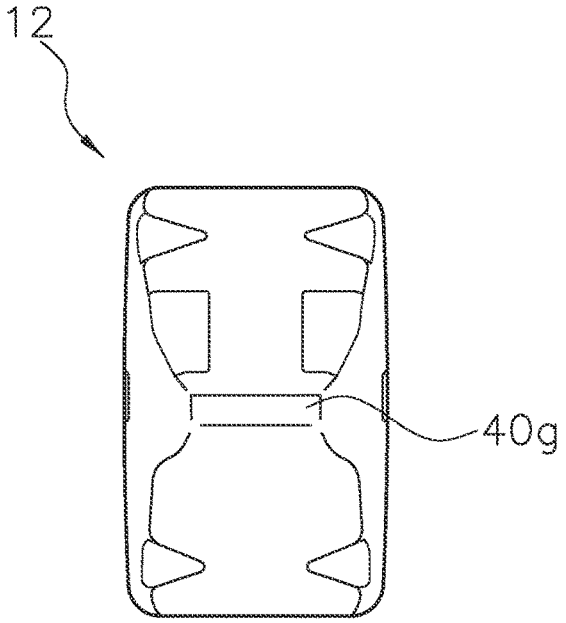
FIG. 8B is a front view of the ripper point in Embodiment 1 of the present disclosure.

As shown in FIG. 8B, the ripper point main body 40 has an outer shape that is substantially parallel to the first surface 40*a*, the second surface 40*b*, the third surface 40*c*, and the fourth surface 40*d*, and is linked to the distal end surface 40*g*.

The guide groove 41 is for guiding the locking member 14 toward the pin member 13. The guide groove 41 is provided on the inner surface of the ripper point main body 40, as shown in FIG. 8A. The guide groove 41 is provided to the third surface 40*c* and to the fourth surface 40*d*. The guide groove 41 extends along the inner surface 40*s* of the ripper point main body 40 from the edge of an opening 40*h* formed at the rear end 40*i* of the ripper point main body 40, toward the distal end surface 40*e* of the ripper point main body 40. The guide groove 41 extends along the direction of the axis A1.

The second pin hole 42 extends through the ripper point main body 40. The second pin hole 42 is formed in the third surface 40*c* and in the fourth surface 40*d*. For example, the second pin hole 42 is formed in the ripper point main body 40 so as to be able to communicate with the first pin hole 23 (see FIG. 7E). The second pin hole 42 is provided to the guide groove 41. The second pin hole 42 passes through the bottom surface 41*a* of the guide groove 41. The pin member 13 is disposed in the second pin hole 42.

As shown in FIGS. 6 and 7, the inner periphery of a cross section obtained by cutting the ripper point 12 along the above-mentioned cutting planes (a) to (e) is formed as follows.

As shown in FIGS. 6 and 7, the portion of the ripper point main body 40 that is opposite the nose portion 22 includes a first portion 51, a second portion 52, and a third portion 53.

As shown in FIG. 7, the first portion 51 is the portion where the ripper point main body 40 is opposite the distal end portion 31 of the nose portion 22. The inner surface of the first portion 51 is formed along the outer surface of the distal end portion 31 of the nose portion 22. The inner periphery of a cross section obtained by cutting the first portion 51 along the cutting plane (a) is formed in a rectangular shape.

As shown in FIGS. 7E and 7F, the second portion 52 is the portion where the ripper point main body 40 is opposite the proximal end portion 32 of the nose portion 22. The inner surface of the second portion 52 is formed along the outer surface of the proximal end portion 32 of the nose portion 22. The inner periphery of a cross section obtained by cutting the second portion 52 along the cutting planes (e) and (f) is formed in a rectangular shape. The second pin hole 42 is mostly formed in the second portion 52, and is partially formed in the third portion 53 (discussed below).

As shown in FIGS. 7B, 7C, and 7D, the third portion 53 is the portion where the ripper point main body 40 is opposite the linking portion 33 of the nose portion 22. The inner surface of the third portion 53 is formed along the outer surface of the linking portion 33 of the nose portion 22. For example, the inner periphery of a cross section obtained by cutting the third portion 53 along the cutting plane (b), the cutting plane (c), and the cutting plane (d) is formed in an octagonal shape.

In the third portion 53, opposite sides L2 of the octagon are formed parallel to the plane P1. As shown in FIGS. 8A, 7B, 7C, and 7D, second ridgeline portions R2 are formed on the inner surface of the third portion 53 by both ends of the sides L2 of the octagon. The second ridgeline portion R2 links the corner portion 51*a* of the first portion 51 and the corner portion 52*a* of the second portion 52. In a state in which the ripper point 12 is attached to the ripper shank 11, the sides L2 are opposing the sides L1, and the second ridgeline portions R2 are disposed so as to be opposite the first ridgeline portions R1 (see FIG. 3) of the ripper shank 11 (linking portion 33). The opposing sides L2 correspond to the widths of the first surface 40*a* and the second surface 40*b* perpendicular to the axis A1.

Also, opposing sides L6 of the octagon perpendicular to the sides L2 are formed. As shown in FIGS. 8A, 7B, 7C, and 7D, fourth ridgeline portions R4 are formed on the inner surface of the third portion 53 by both ends of the sides L6. The fourth ridgeline portion R4 links the corner portion 51*a* of the first portion 51 and the corner portion 52*a* of the second portion 52. In a state in which the ripper point 12 is attached to the ripper shank 11, the sides L6 are opposite the sides L5, and the fourth ridgeline portions R4 are disposed so as to be opposite the third ridgeline portions R3 of the ripper shank 11 (linking portion 33). The opposing sides L6 correspond to the widths of the third surface 40*c* and the fourth surface 40*d* perpendicular to the axis A1.

As shown in FIGS. 7B, 7C, and 7D, the sides L4 that are between the sides L2 and the sides L6 of the third portion 53 and are adjacent to the sides L2 and the sides L6 are each one side of the octagonal perimeter of the third portion 53. The sides L4 form surfaces between the second ridgeline portions R2 and the fourth ridgeline portions R4. The convex portions 40*f* are formed between the second ridgeline portions R2 and the fourth ridgeline portions R4. The sides L4 are provided as four of the eight sides of the octagon. Also, the four sides L4 correspond to the width of the convex portions 40*f* perpendicular to the axis A1.

Here, as shown in FIGS. 7B, 7C, and 7D, the length of the sides L2 of the central portion of the third portion 53 in the lengthwise direction (axis A1 direction) (the length of the sides L2 in FIG. 7C) is shorter than the sides L2 of the third portion 53 on the second portion 52 side (the length of the sides L2 in FIG. 7D). Also, the length of the sides L2 of the central portion of the third portion 53 in the lengthwise direction (the length of the sides L2 in FIG. 7C) is shorter than the length of the sides L2 of the third portion 53 on the first portion 51 side (the length of the sides L2 in FIG. 7B).

The sides L2 gradually become shorter from the second portion 52 toward the central portion of the third portion 53

(see FIGS. 7D and 7C). Also, the sides L2 gradually become longer from the central portion of the third portion 53 toward the first portion 51 (see FIGS. 7C, 7B, and 8A).

As shown in FIGS. 7B, 7C, and 7D, the length of the sides L4 of the central portion of the third portion 53 in the lengthwise direction (the length of the sides L4 in FIG. 7C) is longer than the length of the sides L4 of the third portion 53 on the second portion 52 side (the length of the sides L4 in FIG. 7D). Also, the length of the sides L4 of the central portion of the third portion 53 in the lengthwise direction (the length of the sides L4 in FIG. 7C) is longer than the length of the sides L4 of the third portion 53 on the first portion 51 side (the length of sides L4 in FIG. 7B).

The sides L4 gradually become longer from the second portion 52 toward the central portion of the third portion 53 (see FIGS. 7D, 7C, and 8A). Also, the sides L4 gradually become shorter from the central portion of the third portion 53 toward the first portion 51 (see FIGS. 7C and 7B).

The sides L6 gradually become shorter from the second portion 52 toward the central portion of the third portion 53 (see FIGS. 7D, 7C, and 8A). Also, the sides L6 gradually become shorter from the central portion of the third portion 53 toward the first portion 51 (see FIGS. 7C and 7B).

The rectangular vertex of the first portion 51 (corner 51*a*), the octagonal vertex of the third portion 53, and the rectangular vertex of the second portion 52 (corner 52*a*) are connected in that order from the portion 51, via the third portion 53, toward the second portion 52.

Thus forming the second ridgeline portion R2 and the fourth ridgeline portion R4 on the inner surface of the ripper point 12, and forming the first ridgeline portion R1 and the third ridgeline portion R3 on the ripper shank 11 as described above allows the ripper point 12 to be positioned relative to the ripper shank 11. That is, the spacing between the ripper point 12 and the ripper shank 11 can be kept small.

Pin Member 13

Figure 10A:
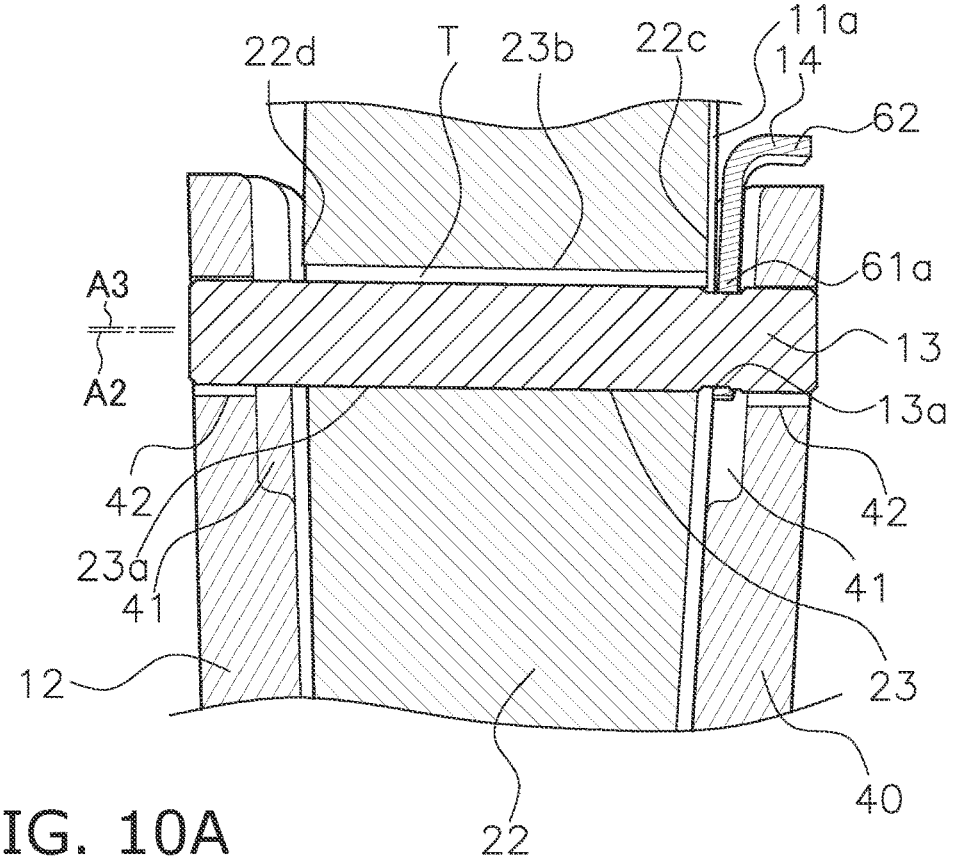
FIG. 10A is a cross-sectional view along the E-E' line in FIG. 2C.
Figure 10B:
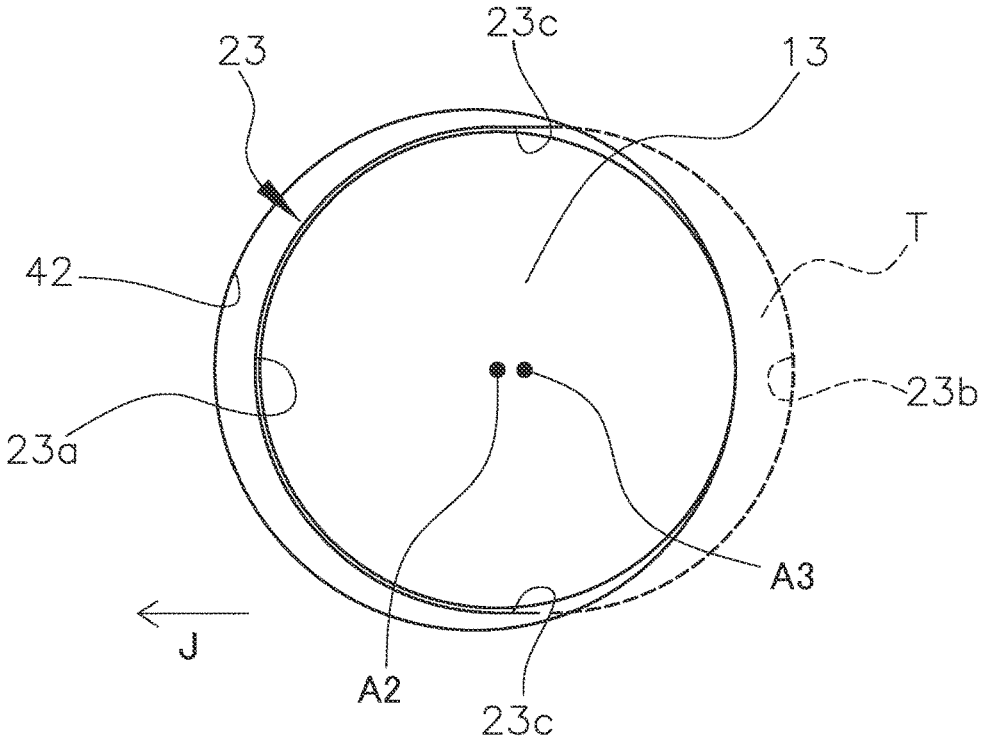
FIG. 10B is a side view showing the positional relation between a pin member and a pin hole of the ripper point attachment structure in Embodiment 1 of the present disclosure.
Figure 11:
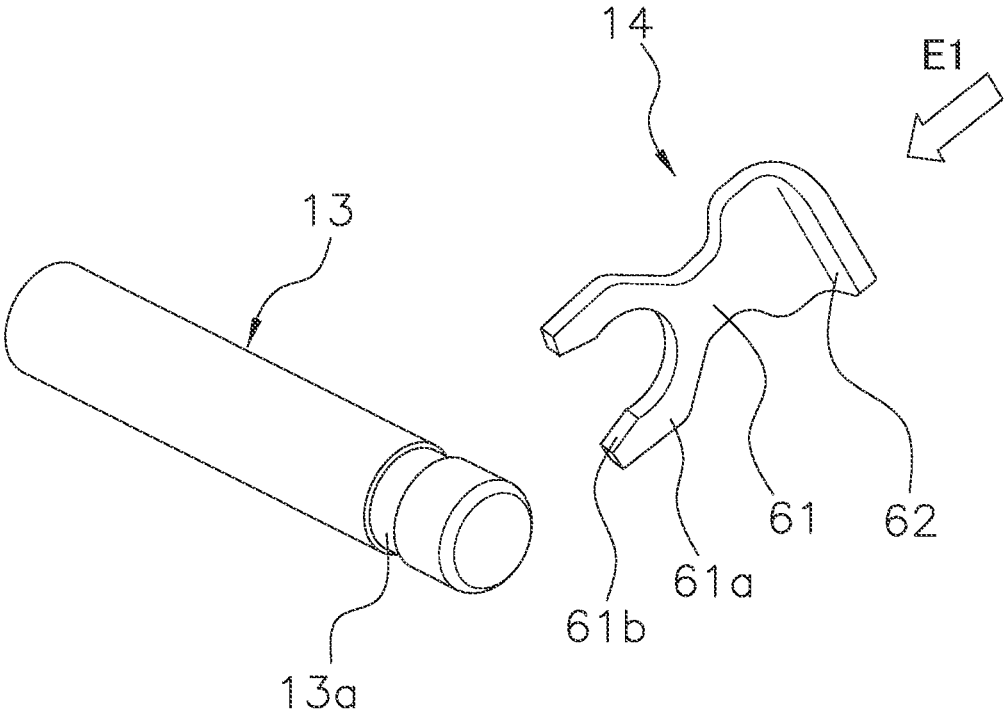
FIG. 11 is an oblique view of the pin member and the locking member of the ripper point attachment structure in Embodiment 1 of the present disclosure.

FIG. 10A is a cross-sectional view taken along the E-E' line in FIG. 2C. FIG. 10B is a diagram showing the positional relation between the pin member 13 and the first pin hole 23 and the second pin hole 42. FIG. 11 is an oblique view of the pin member 13 and the locking member 14.

As shown in FIG. 3, the pin member 13 links the ripper shank 11 and the ripper point 12. The pin member 13 is disposed in the first pin hole 23 and the second pin hole 42. The pin member 13 is formed in a cylindrical shape. In addition, the pin member 13 may be formed in a tubular shape. The pin member 13 has an axis A2.

As shown in FIG. 9, in a state in which the distal end surface 22*e* of the nose portion 22 is in contact with the distal end surface 40*e* of the internal space S of the ripper point 12, the pin member 13 is disposed in the first pin hole 23 and the second pin hole.

In this state, the pin member 13 is in contact with the first inner peripheral surface 23*a* of the first pin hole 23 on the distal end portion 31 side of the nose portion 22, as shown in FIG. 10. Also, the pin member 13 is in contact with the inner peripheral surface of the second pin hole 42 on the main body portion 21 side of the ripper point main body 40 (the opposite side from the distal end portion 31).

In this state, as shown in FIGS. 10A and 10B, the axis A2 is offset from the center A3 of the first pin hole 23 to the distal end portion 31 side of the nose portion 22. In FIG. 10B, the arrow J indicates the distal end portion 31 side.

With this configuration, in a state in which the pin member 13 is disposed in the first pin hole 23 of the ripper shank 11 and the second pin hole 42 of the ripper point 12, a gap T is formed between the pin member 13 and the second inner peripheral surface 23*b* of the first pin hole 23 on the main body portion 21 side. This gap T makes it less likely that the pin member 13 will come into contact with the main body portion 21 side of the first pin hole 23 during excavation work and piercing work with the ripper device 1. This improves the durability of the pin member 13 and the first pin hole 23.

Also, the pin member 13 includes an annular groove 13*a*. The annular groove 13*a* is formed in the outer peripheral surface of the pin member. The annular groove 13*a* is formed near one or both ends of the pin member 13. The annular groove 13*a* is disposed between the ripper shank 11 and the ripper point 12. More precisely, the annular groove 13*a* of the pin member 13 is disposed in the guide groove 41.

The locking member 14 is engaged with the annular groove 13*a*. More precisely, an engaging portion 61*a* (discussed below) of the locking member 14 is engaged with the annular groove 13*a*.

Locking Member 14

The locking member 14 is used to prevent the pin member 13 from coming loose. As shown in FIG. 11, locking member 14 engages with the pin member 13 by sliding toward pin member 13. The locking member 14 engages with the pin member 13 by sliding in the direction going from the main body portion 21 side of the ripper shank 11 toward the pin member 13.

The locking member 14 is disposed between the ripper shank 11 and the ripper point 12. The locking member 14 is disposed between the outer surface of the nose portion 22 and the inner surface of the ripper point main body 40. The locking member 14 is disposed in the guide groove 41 (see FIG. 10A).

The locking member 14 includes a lock body 61 and a catch portion 62.

The lock body 61 is, for example, a flat member. The lock body 61 include an engaging portion 61*a* and an open portion 61*b*. The engaging portion 61*a* is the portion that engages with the pin member 13. The engaging portion 61*a* include a C-shaped inner peripheral surface. The engaging portion 61*a* is fitted into the annular groove 13*a* of the pin member 13. The open portion 61*b* is the portion that guides the pin member 13 to the engaging portion 61*a*. The distance between the open ends of the open portion 61*b* is greater than the diameter of the annular groove 13*a* of the pin member 13.

As shown in FIG. 11, the catch portion 62 is the portion protruding from the lock body 61. For example, the catch portion 62 is formed integrally with the lock body 61. As shown in FIG. 10A, the catch portion 62 is located outside the ripper point 12 and is disposed on the third surface 22*c* of the nose portion 22. The third surface 22*c* is part of the entire side surface 11*a* of the ripper shank 11 shown in FIGS. 1 and 10A.

The locking member 14 including the above configuration is attached as follows.

First, the ripper point 12 is attached to the ripper shank 11. The pin member 13 is then inserted into the second pin hole 42 of the ripper point 12 and the first pin hole 23 of the ripper shank 11. The annular groove 13*a* of the pin member 13 is disposed in the guide groove 41 as shown in FIG. 10A.

Figure 12A:
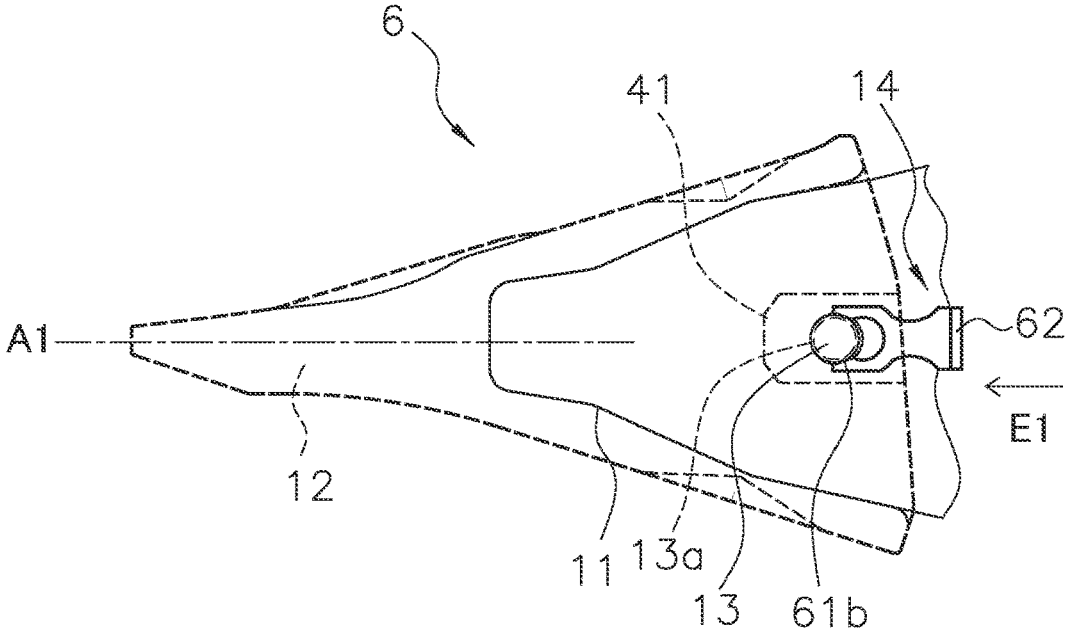
FIG. 12A is a side view showing an unlocked state of the ripper point attachment structure in Embodiment 1 of the present disclosure.

The locking member 14 is inserted into the guide groove 41 from the edge of the opening 40*h* in the ripper point 12. FIG. 12A is a side view showing a state in which the locking member 14 has been inserted into the guide groove 41. In FIG. 12A, the ripper point 12 is shown by a dashed line for the sake of illustration.

The locking member 14 is disposed such that the open portion 61*b* of the lock body 61 is opposite the annular groove 13*a* of the pin member 13 (see FIG. 12A). This state is one in which the locking member 14 and the pin member 13 are disengaged (unlocked state).

Figure 12B:
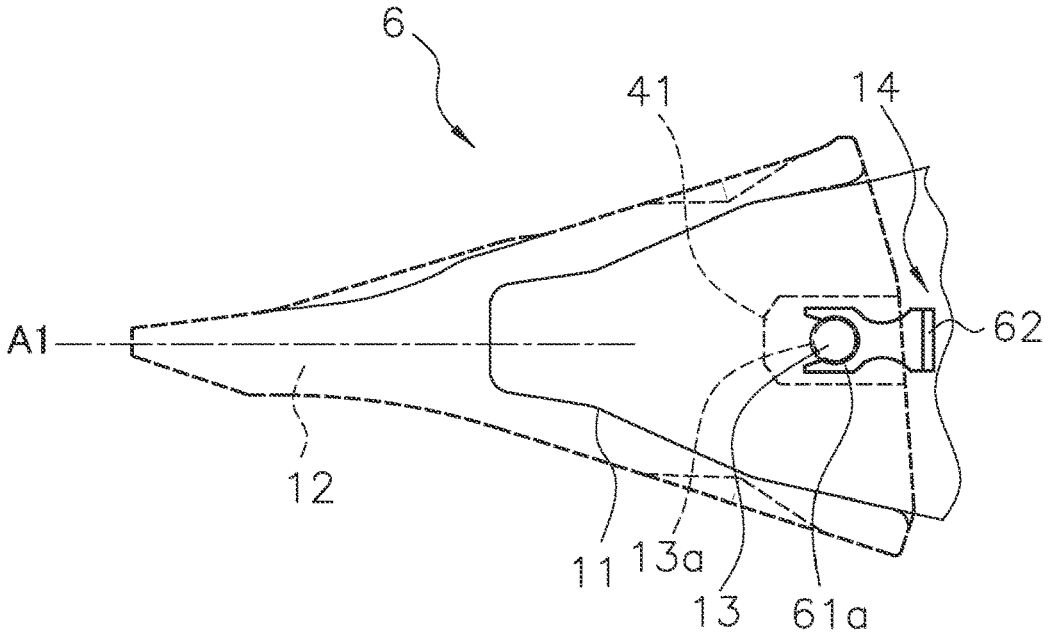
FIG. 12B is a side view showing a locked state of the ripper point attachment structure in Embodiment 1 of the present disclosure.

In this unlocked state, the catch portion 62 is pressed toward the pin member 13 (see the arrow E1). This causes the lock body 61 to slide along the guide groove 41 toward the pin member 13, and fits the engaging portion 61*a* of the lock body 61 into the annular groove 13*a* of the pin member 13 (see FIG. 12B). This is a state in which the locking member 14 and the pin member 13 are engaged (locked state).

When the locking member 14 is thus slid toward the pin member 13 in the unlocked state, the pin member 13 is prevented from coming loose. Also, when the locking member 14 is slid away from the pin member 13 in the locked state, the pin member 13 is allowed to come loose.

Embodiment 2

Figure 13A:
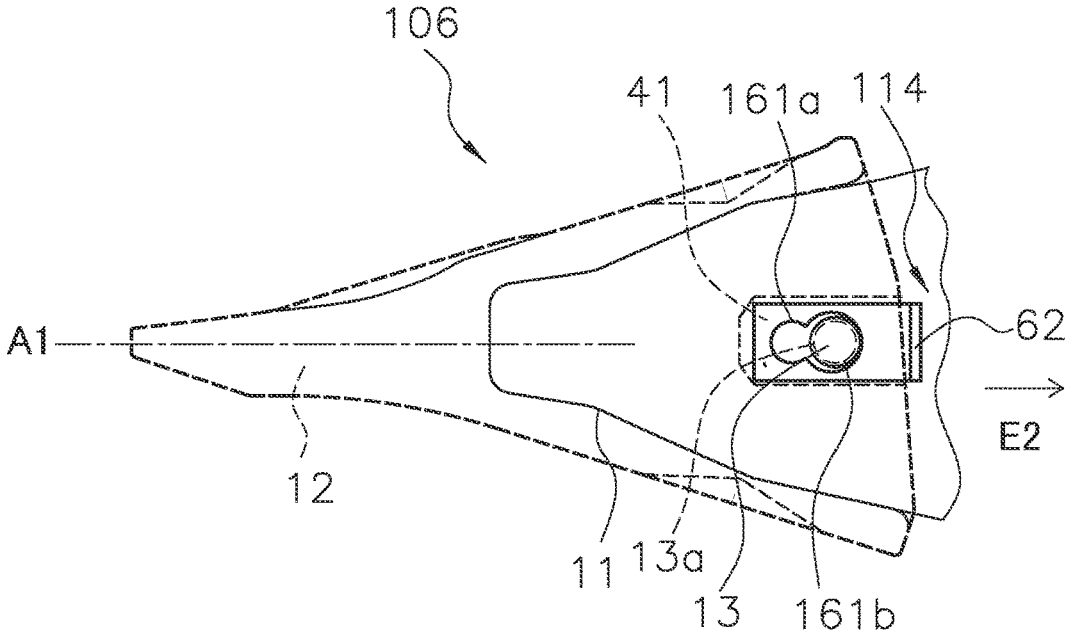
FIG. 13A is a side view showing an unlocked state of the ripper point attachment structure in Embodiment 2 of the present disclosure.
Figure 13B:
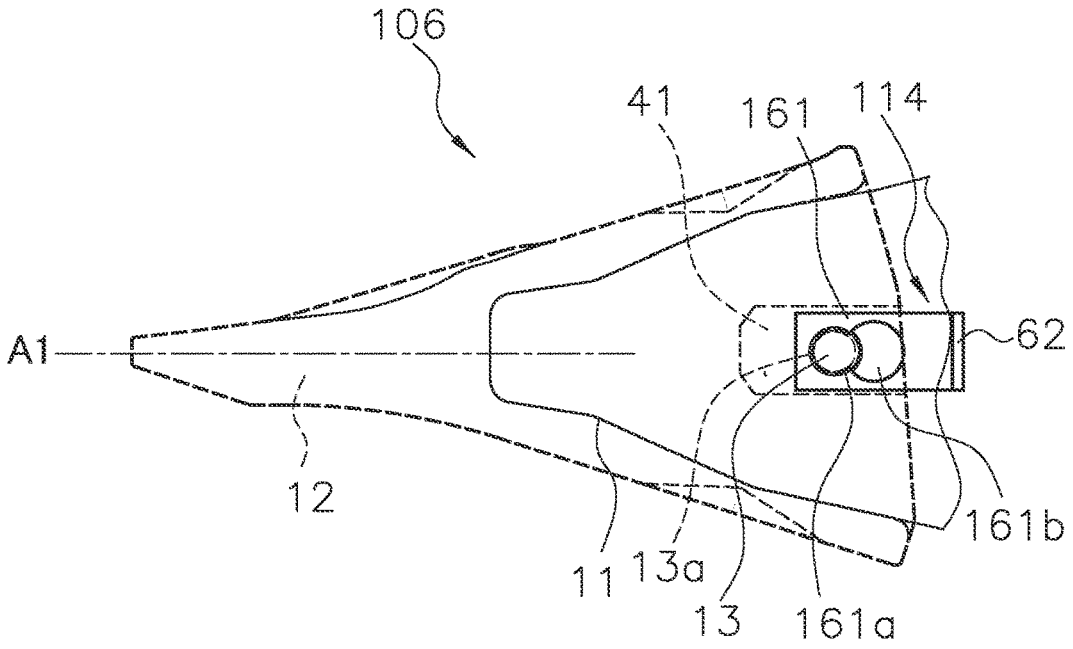
FIG. 13B is a side view showing a locked state of the ripper point attachment structure in Embodiment 2 of the present disclosure.
Figure 13C:
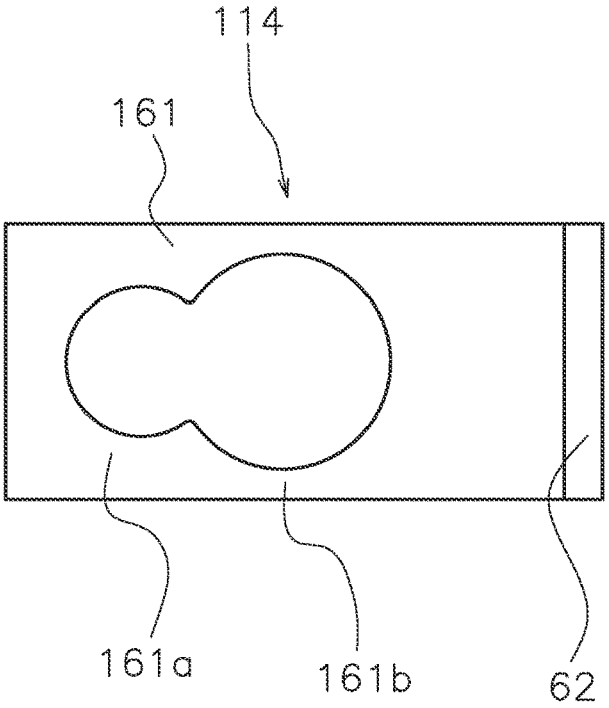
FIG. 13C is a side view showing a locking member of the ripper point attachment structure in Embodiment 2 of the present disclosure.

In Embodiment 1, an example was given in which the locking member 14 engaged with the pin member 13 by being slid from the main body portion 21 of the ripper shank 11 toward the pin member 13 (the distal end direction). Instead of this, the ripper point attachment structure 106 of Embodiment 2 may be configured as shown in FIGS. 13A to 13C. Any components not described here are the same as in the configuration of the above embodiment.

In this case, as shown in FIGS. 13A and 13B, a locking member 114 engages with the pin member 13 by being slid away from the pin member 13. For example, the locking member 114 engages with the pin member 13 by sliding from the pin member 13 toward the main body portion 21 side (the opposite direction from the distal end direction).

The locking member 114 includes a lock body 161 and the catch portion 62, as shown in FIG. 13C. The configuration of the catch portion 62 is the same as that in the above embodiment.

As shown in FIG. 13C, the lock body 161 is form in the shape of a rectangular plate, for example. The lock body 161 include an engaging portion 161*a* and an open portion 161*b*. The engaging portion 161*a* is the portion that engages with the pin member 13. The engaging portion 161*a* has a C-shaped inner peripheral surface, for example. The engaging portion 161*a* is fitted into the annular groove 13*a* of the pin member 13.

The open portion 161*b* is the portion where the pin member 13 is disposed before being engaged with the engaging portion 161*a*. The open portion 161*b* is provided between the engaging portion 161*a* and the catch portion 62. The open portion 161*b* include a C-shaped inner peripheral surface. The diameter of the open portion 161*b* is larger than the diameter of the pin member 13.

The locking member 114 including the above configuration is attached as follows.

First, the ripper point 12 is attached to the ripper shank 11. The locking member 114 is then inserted into the guide groove 41. The locking member 114 is disposed such that the open portion 161*b* is opposite the first pin hole 23 and the second pin hole 42.

Next, the pin member 13 is inserted into the second pin hole 42 of the ripper point 12, the open portion 161*b* of the locking member 114, and the first pin hole 23 of the nose portion 22 of the ripper shank 11.

The annular groove 13*a* of the pin member 13 is disposed opposite the open portion 161*b* of the lock body 161 (see FIG. 13A). This is a state in which the locking member 114 and the pin member 13 are disengaged (unlocked state).

In this unlocked state, the catch portion 62 is pressed toward the main body portion 21 side (the arrow E2 side). This causes the lock body 161 to slide away from the pin member 13. As a result, the engaging portion 161*a* of the lock body 161 fits into the annular groove 13*a* of the pin member 13 (see FIG. 13B). This is a state in which the locking member 114 and the pin member 13 are engaged (locked state).

When the locking member 114 is thus slid away from the pin member 13 in the locked state, the pin member 13 is prevented from coming loose. Also, when the locking member 114 is slid toward the pin member 13 in the locked state, the pin member 13 is allowed to come loose.

Figure 13D:
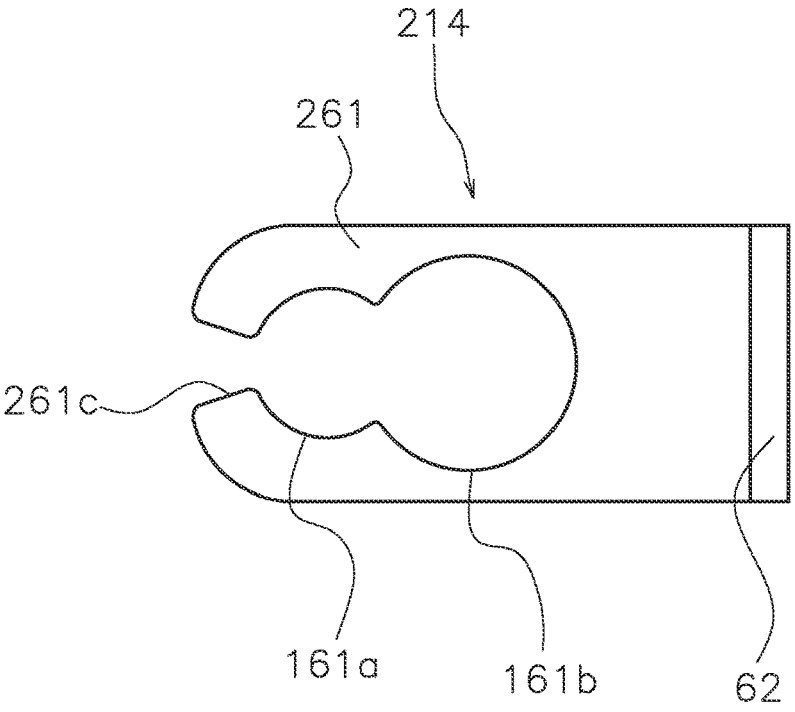
FIG. 13D is a side view showing the locking member of the ripper point attachment structure in a modification example of Embodiment 2 of the present disclosure.

The locking member 114 that is slid away from the pin member 13 is not limited to the shape shown in FIG. 13C, and may instead be a locking member 214 as shown in FIG. 13D.

The locking member 214 shown in FIG. 13D includes a lock body 261 in which a cutout 261*c* is formed around the engaging portion 161*a*. The cutout 261*c* is formed from the portion of the engaging portion 161*a* where the pin member 13 is disposed to the outer edge. The cutout 261*c* is formed so as to conform to the sliding direction. This divides the engaging portion 161*a* into two parts.

The locking member 214 is attached in the same manner as the locking member 114. The annular groove 13*a* of the pin member 13 is disposed opposite the open portion 161*b* of the lock body 261, and the catch portion 62 is pressed toward the main body portion 21 side (the arrow E2 side). Consequently, the lock body 261 slides away from the pin member 13, and the engaging portion 161*a* of the lock body 261 fits into the annular groove 13*a* of the pin member 13.

Embodiment 3

With the locking member 114 of Embodiments 1 and 2 described above, the catch portion 62 is only disposed on the side surface 11*a* of the ripper shank 11, but a guarded configuration may be used as in Embodiment 3. Any components not described here are the same as in the configuration of the above embodiment.

Figure 14B:
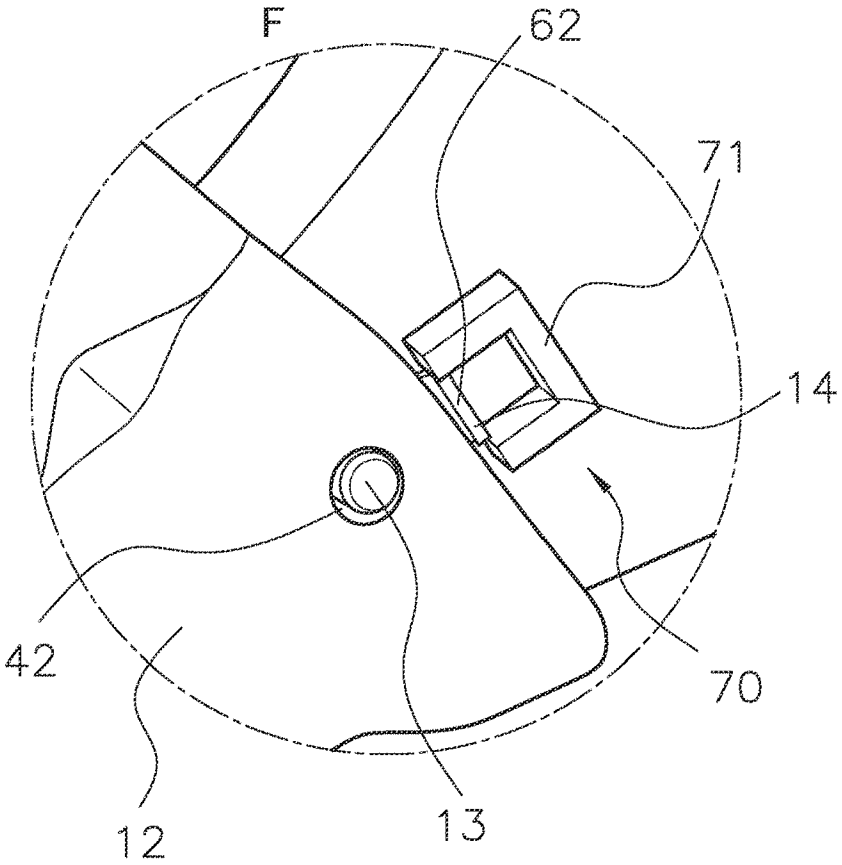
FIG. 14B is a detail view of part F in FIG. 14A.
Figure 14A:
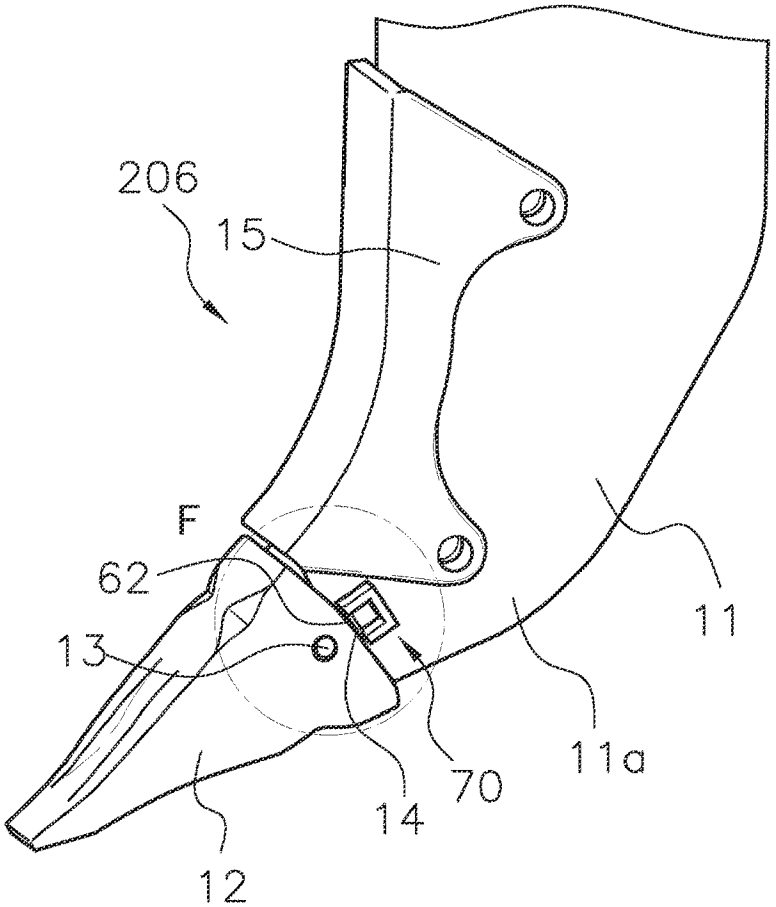
FIG. 14A is a side view of a ripper point attachment structure in Embodiment 3 of the present disclosure.

FIG. 14A is an oblique view of a ripper point attachment structure 206 including a guard portion 70 around the catch portion 62. FIG. 14B is a detail view of part F in FIG. 14A.

The ripper point attachment structure 206 of Embodiment 3 further comprises the guard portion 70. The guard portion 70 is provided to prevent earth and sand from hitting the catch portion 62. The guard portion 70 includes a plurality of convex portions 71 that are fixed to the side surface 11*a* of the ripper shank 11. For example, in FIG. 14B, a convex portion 71 is provided in a U shape in side view so as to surround the periphery of the catch portion 62 except for the ripper point 12 side. From the standpoint of protecting the catch portion 62, the height of the convex portion 71 from the side surface 11*a* is preferably greater than the height of the catch portion 62 from the side surface 11*a*.

The guard portion 70 also has a guide function when the locking member 14 is slid.

In Embodiment 3, the guard portion 70 was applied to the locking member 14 having the shape as in Embodiment 1, but it can also be applied to the locking member 114 having the shape as in Embodiment 2.

The ripper point attachment structures 6, 106, and 206 of any of Embodiments 1, 2, and 3 are a ripper point attachment structure in the ripper device 1, and comprise the ripper point 12, the ripper shank 11, the pin member 13, and the locking member 14. The ripper point 12 includes a wedge shape extending from a distal end surface 40*g* (an example of a distal end) to a rear end 40*i*. The ripper point 12 is attached to the ripper shank 11. The pin member 13 is inserted into the first pin hole 23 (an example of a first through hole) formed in the ripper shank 11 and the second pin hole 42 (an example of a second through hole) formed in the ripper point 12. The locking members 14 and 114 are engaged with the pin member 13 to prevent the pin member 13 from coming loose. The ripper point 12 includes the opening 40*h* (an example of an opening), the internal space S, and a guide groove 41 (an example of a concave portion). The opening 40*h* is formed at the rear end 40*i*. The internal space S is formed from the opening 40*h* toward the distal end surface 40*g* (an example of a distal end). The guide groove 41 is formed in a predetermined range from the rear end 40*i* toward the distal end surface 40*g* in a portion of the inner surface 40*s* forming the internal space S. The second pin hole 42 of the ripper point 12 is disposed on the bottom surface 41*a* of the guide groove 41. The locking members 14 and 114 are disposed in the space forming the guide groove 41.

Accordingly, by inserting the locking members 14 and 114 into the guide groove 41 and arranging the locking members 14 and 114, the locking members 14 and 114 can be easily disposed at the ripper shank 11 and the ripper point 12. From this state, by sliding the locking members 14 and 114 along the guide groove 41, the pin member 13 disposed in the second pin hole 42 is prevented from coming loose by the locking members 14 and 114, and a locked state can be established. Thus, the ripper point 12 can be easily attached to the ripper shank 11 by the pin member 13.

Further, by sliding the locking members 14 and 114 with respect to the pin member 13 from the locked state, the preventing the pin member 13 to come loose can be released. Thus, the ripper point 12 can be easily detached from the ripper shank 11.

As described above, in the ripper point attachment structures 6, 106, and 206 of the present embodiments, the ripper point 12 can be easily attached to and detached from the ripper shank 11.

Further, by sliding the locking members 14, and 114 along the guide groove 41, the locking members 14, and 114 can be engaged with the pin member 13.

With the ripper point attachment structures 6 and 206 of Embodiments 1 and 3, the locking member 14 engages with the pin member 13 by sliding in the direction toward the pin member 13.

By sliding the locking member 14 toward the pin member 13 along the guide groove 41 in this manner, the locking member 14 can be engaged with the pin member 13.

With the ripper point attachment structure 106 of Embodiment 2, the locking member 114 engages with the pin member 13 by sliding in the direction away from the pin member 13.

In this manner, the locking member 114 can be engaged with the pin member 13 by sliding the locking member 114 along the guide groove 41 in the direction away from the pin member 13.

With the ripper point attachment structures 6, 106, and 206 of any of Embodiments 1, 2 and 3, the locking members 14 and 114 include the engaging portions 61*a* and 161*a* engaging with the pin member 13.

The locking members 14 and 114 can engage the pin member 13 with the engaging portions 61*a* and 161*a*.

With the ripper point attachment structures 6, 106 and 206 of any one of Embodiments 1, 2 and 3, the locking members 14 and 114 further include open portions 61*b* and 161*b* to guide the pin member 13 to the engaging portions 61*a* and 161*a*.

The locking members 14 and 114 guide the pin member 13 to the engaging portions 61*a* and 161*a* through the open portions 61*b* and 161*b*, and can be engaged at the engaging portions 61*a* and 161*a*.

With the ripper point attachment structures 6, 106, and 206 of any of Embodiments 1, 2, and 3, the locking members 14, 114 further include catch portions 62.

By pressing the catch portion 62, the locking members 14 and 114 can be easily slid.

With the ripper point attachment structures 6, 106 and 206 of any of Embodiments 1, 2 and 3, the pin member 13 includes an annular groove 13*a* with which the engaging portions 61*a*, 161*a* are engaged.

By engaging the engaging portions 61*a* and 161*a* with the annular groove 13*a*, it is possible to prevent the pin member 13 from coming loose more firmly.

Since the locking members 14 and 114 slide in the guide groove 41 and engage with the pin member 13, the annular groove 13*a* is provided outside the first pin hole 23 and inside the second pin hole 42. As a result, it is not necessary to form a reduced-diameter portion for disposing the retainer in the portion of the pin member located inside the pin hole, so it is possible to reduce the risk of breakage.

With the ripper point attachment structures 6, 106 and 206 of any of Embodiments 1, 2 and 3, the locking member 14 engages the pin member 13 between the ripper shank 11 and the ripper point 12.

Thereby, the pin member 13 can be engaged by the locking member 14 between the ripper shank 11 and the ripper point 12. Since the ripper point 12 is disposed outside the engaging portion, it is possible to protect the engagement from earth and sand, etc., and to prevent the pin member 13 from coming loose.

The ripper point attachment structure 206 of Embodiment 3 further includes the guard portion 70 disposed on the side surface 11*a* (an example of an outer surface) of the ripper shank 11 and protecting the locking member 14.

This can prevent earth and sand from colliding with the locking member

With the ripper point attachment structures 6, 106 and 206 of any of Embodiments 1, 2 and 3, the ripper shank 11 includes a first pin hole 23 (an example of a through hole) in which the pin member 13 is disposed. The first pin hole 23 is formed in an elongated shape.

Consequently, the pin member 13 is brought into contact with the first inner peripheral surface 23*a* on the distal end side of the ripper shank 11, out of the inner peripheral surface of the first pin hole 23, and does not come into contact with the second inner peripheral surface 23*b* on the opposite side from the distal end (the main body portion 21 side), so the gap T can be formed between the pin member 13 and the second inner peripheral surface 23*b*.

Therefore, during excavation work and piercing work with the ripper device 1, the pin member 13 is less likely to come into contact with the main body portion 21 side of the first pin hole 23. This improves the durability of the pin member 13 and the first pin hole 23.

The ripper point 12 of any of Embodiments 1, 2, and 3 is a ripper point being attachable to the ripper shank 11, and includes the ripper point main body 40, the guide groove 41 (an example of a concave portion), and the second pin hole 42 (an example of a through hole). The ripper point main body 40 includes the opening 40*h* (an example of an opening) formed at the rear end 40*i* and the internal space S formed from the opening 40*h* toward the distal end surface 40*g* (an example of a distal end). The guide groove 41 is formed in a predetermined range extending from the rear end 40*i* to the distal end surface 40*g* in a portion of the inner surface 40*s* forming the internal space S. The second pin hole 42 (an example of a through hole) is provided on the bottom surface 41*a* of the guide groove 41.

Accordingly, by inserting the locking members 14 and 114 into the guide groove 41 and disposing the locking members 14 and 114, the locking members 14 and 114 can be easily disposed at the ripper shank 11 and the ripper point 12. From this state, by sliding the locking members 14 and 114 along the guide groove 41, the pin member 13 disposed in the second pin hole 42 is prevented from coming loose by the locking members 14 and 114, and a locked state can be established. Thus, the ripper point 12 can be easily attached to the ripper shank 11 by the pin member 13.

Further, by sliding the locking members 14 and 114 from the locked state, the pin member 13 can be released from being prevented from coming loose. Thus, the ripper point 12 can be easily detached from the ripper shank 11.

As described above, with the ripper point attachment structures 6, 106, and 206 of the present embodiment, the ripper point 12 can be easily attached to and detached from the ripper shank 11.

Further, by sliding the locking members 14 and 114 along the guide groove 41, the locking members 14 and 114 can be engaged with the pin member 13.

Embodiments of the present invention were described above, but the present invention is not limited to or by the above embodiments, and various modifications are possible without departing from the gist of the invention.

In the above embodiments, the first pin hole 23 had a cross section perpendicular to the center A3 that was of a consistent size, but the two ends in the direction in which the center A3 extends may be larger in diameter than the central portion.

Figure 15:
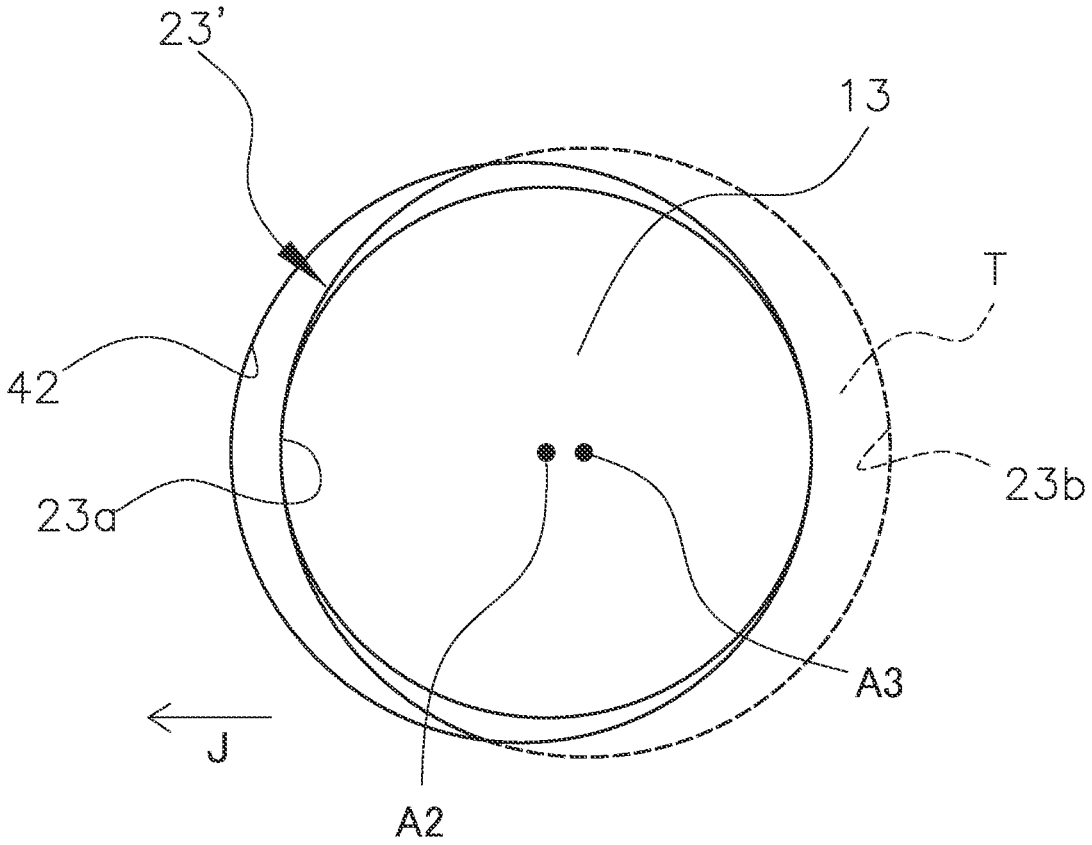
FIG. 15 is a side view showing the positional relation of the pin member and the pin hole of the ripper point attachment structure in a modification example of an embodiment of the present disclosure.

Also, in the above embodiments, the first pin hole 23 was formed in an elongated hole shape, but may instead be a normal circular hole, such as the first pin hole 23' shown in FIG. 15. The first pin hole 23' has a circular shape with a constant radius, and unlike the first pin hole 23, is not provided with the pair of third inner peripheral surfaces 23*c*, and instead the first inner peripheral surface 23*a* and the second inner peripheral surface 23*b* are directly linked. In addition, the diameter of the first pin hole 23' is formed larger than the diameter of the pin member 13.

In the above embodiments an example was given in which the locking member 14 prevented the pin member 13 from coming loose, but the pin member 13 may be held in place by the use of a retainer or other such latching member.

Figure 16A:
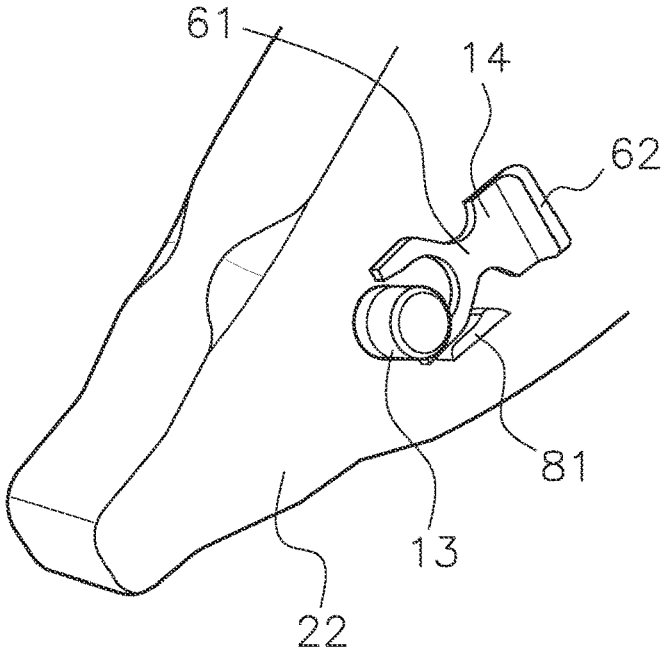
FIG. 16A is an oblique view of a state in which the pin member and the locking member are disposed on the ripper shank in a modification example of an embodiment of the present disclosure.
Figure 16B:
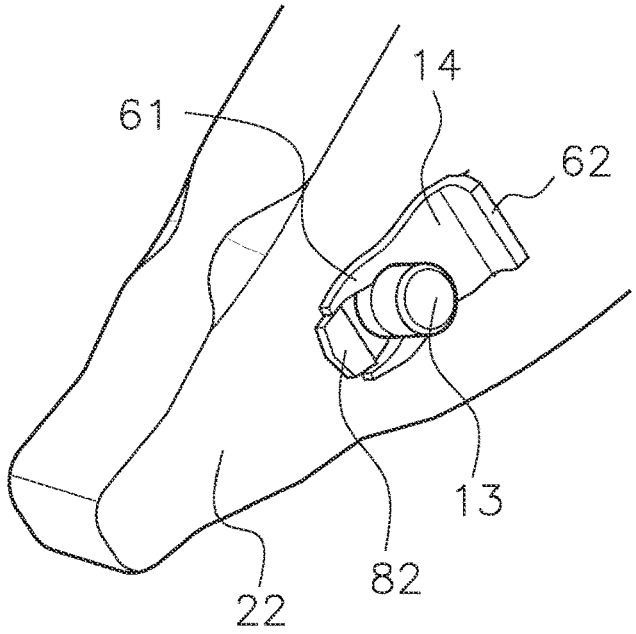
FIG. 16B is an oblique view of a state in which the pin member and the locking member are disposed on the ripper shank in a modification example of an embodiment of the present disclosure.

The ripper point attachment structures 6, 106, and 206 of the above embodiments do not include a component for positioning the locking member 14, but as shown in FIGS. 16A and 16B, the ripper point attachment structure 6 may include a component for positioning the locking member 14.

In this case, for example, the ripper shank 11 further includes a convex component 81 or a convex component 82. The convex components 81 and 82 are provided on the outer surface of the ripper shank 11. The convex components 81 and 82 are formed on the outer surface of the nose portion 22.

The convex component 81 in FIG. 16A supports the locking member 14 (the lock body 61, for example) in the unlocked state. In a state in which the ripper point 12 has been placed on the ripper shank 11, the convex component 81 is placed in the guide groove 41 of the ripper point 12. Thus providing the convex component 81 on the ripper shank 11 allows the locking member 14 to be easily positioned with respect to the ripper shank 11.

The convex component 82 in FIG. 16B engages the locking member 14 (the lock body 61, for example) in the locked state. In a state in which the ripper point 12 has been placed on the ripper shank 11, the convex component 82 is disposed in the guide groove 41 of the ripper point 12. Thus providing the convex component 82 on the ripper shank 11 allows the locking member 14 to be easily positioned with respect to the ripper shank 11. The ripper point attachment structures 6, 106, and 206 may also include the configurations in both FIGS. 16A and 16B.

In Embodiment 3, the guard portion 70 that guarded the catch portion 62 was provided, and was provided as a separate member from the protector 15, but the protector 15 and the guard portion 70 may be formed as a single member. Also, the shape of the guard portion 70 surrounding the catch portion 62 is not limited to the rectangular shape shown in FIGS. 14A and 14B, and may be curved instead.

Figure 17:
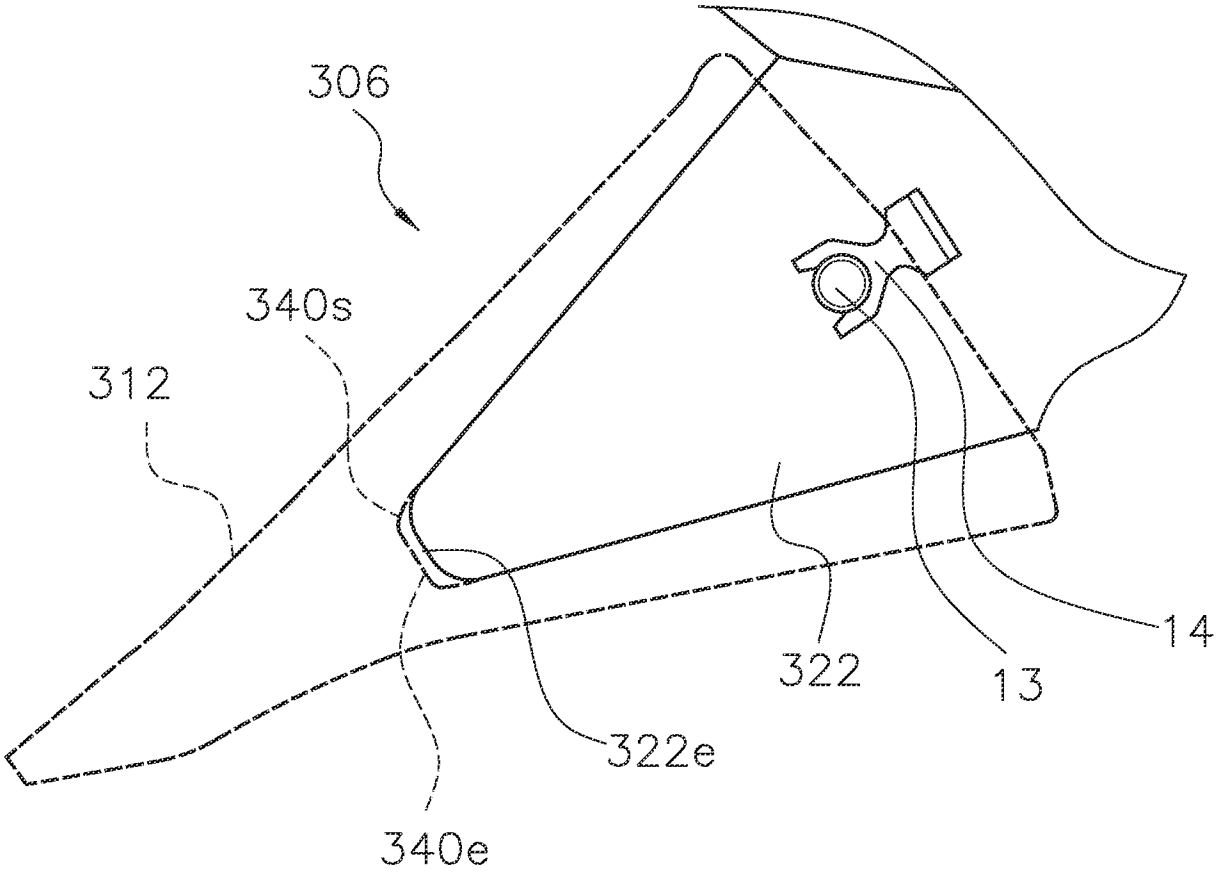
FIG. 17 is a side view showing the ripper point attachment structure in a modification example of an embodiment of the present disclosure.

In embodiments 1 to 3, the concave portion 22*f* was formed on the nose portion 22, and the nose portion 22 included the linking portion 33 with an octagonal cross-sectional shape, but the concave portions 22*f* may not be formed. FIG. 17 is a side view showing a ripper point attachment structure 306 provided with a nose portion 322 without concave portions 22*f*. In FIG. 17, the ripper point 312 is indicated by dashed lines. The inner surface 340*s* of the ripper point 312 is not formed with the convex portion 40*f* described above. Also, the distal end surface 322*e* of the nose portion 322 may not be in contact with the distal end surface 340*e* of the inner surface 340*s*.

In the above embodiments, the first pin hole 23 was provided to the proximal end portion 32, but this is not the only option, and this hole may instead be provided to the linking portion 33.

The ripper point attachment structure and ripper point of the present disclosure have the effect that the ripper point can be easily attached and detached, and are useful, for example, as a ripper device for used in bulldozers and motor graders.

What is claimed is:

1. A ripper point attachment structure in a ripper device, comprising:

a ripper point having a wedge shape extending from a distal end to a rear end;

a ripper shank, the ripper point being attached to the ripper shank;

a pin member inserted into a first through hole formed in the ripper shank and a second through hole formed in the ripper point; and a locking member engaging the pin member to prevent the pin member from coming loose, the ripper point including an opening formed at the rear end, an internal space formed from the opening toward the distal end, and a concave portion formed in a predetermined range from the rear end to the distal end in a portion of an inner surface forming the internal space, the second through hole of the ripper point being disposed on a bottom surface of the concave portion, and the locking member being disposed in a space forming the concave portion, the locking member engaging the pin member by sliding in a direction toward the pin member or the locking member engaging the pin member by sliding in a direction away from the pin member.

2. The ripper point attachment structure according to claim 1, wherein the locking member includes an engaging portion engaging the pin member.

3. The ripper point attachment structure according to claim 2, wherein the locking member further includes an open portion to guide the pin member to the engaging portion.

4. The ripper point attachment structure according to claim 2, wherein the locking member further includes a catch portion.

5. The ripper point attachment structure according to claim 2, wherein the pin member includes an annular groove engaged by the engaging portion.

6. The ripper point attachment structure according to claim 1, wherein the locking member engages the pin member between the ripper shank and the ripper point.

7. The ripper point attachment structure according to claim 6, further comprising a guard portion disposed on an outer surface of the ripper shank, the guard portion protecting the locking member.

8. The ripper point attachment structure according to claim 6, wherein the first through hole being formed in an elongated shape.

9. A ripper point configured to be attached to a ripper shank, the ripper point comprising:

a ripper point main body including an opening formed at a rear end and an internal space formed from the opening toward a distal end;

a concave portion formed in a predetermined range from the rear end to the distal end in a portion of an inner surface forming the internal space; and a first through hole provided on a bottom surface of the concave portion, a pin member inserted into the first through hole and a second through hole formed in the ripper shank, and a locking member engaging the pin member to prevent the pin member from coming loose, the locking member being disposed in the concave portion, the locking member engaging the pin member by sliding in a direction toward the pin member or the locking member engaging the pin member by sliding in a direction away from the pin member.

* * * * *